United States Patent [19]

Suzuki et al.

[11] Patent Number: 4,784,905

[45] Date of Patent: Nov. 15, 1988

[54] THERMOSENSITIVE IMAGE TRANSFER RECORDING MEDIUM

[75] Inventors: Akira Suzuki, Mishima; Nobuo Mochizuki, Shizuoka; Motoo Tasaka, Susono; Mitsuru Hashimoto, Numazu, all of Japan

[73] Assignee: Ricoh Company, Ltd., Tokyo, Japan

[21] Appl. No.: 834,763

[22] Filed: Feb. 28, 1986

[30] Foreign Application Priority Data

| | | | |
|---|---|---|---|
| Mar. 1, 1985 | [JP] | Japan | 60-038868 |
| Mar. 1, 1985 | [JP] | Japan | 60-038869 |
| Jun. 27, 1985 | [JP] | Japan | 60-138987 |
| Jun. 27, 1985 | [JP] | Japan | 60-138986 |
| Jul. 29, 1985 | [JP] | Japan | 60-166024 |
| Jul. 29, 1985 | [JP] | Japan | 60-166020 |
| Jul. 31, 1985 | [JP] | Japan | 60-167477 |
| Aug. 1, 1985 | [JP] | Japan | 60-168562 |
| Sep. 2, 1985 | [JP] | Japan | 60-192098 |
| Oct. 1, 1985 | [JP] | Japan | 60-216187 |
| Nov. 11, 1985 | [JP] | Japan | 60-250894 |
| Nov. 14, 1985 | [JP] | Japan | 60-253723 |

[51] Int. Cl.[4] ..... B41M 5/26

[52] U.S. Cl. ..... 428/321.3; 428/195; 428/207; 428/323; 428/327; 428/328; 428/329; 428/331; 428/484; 428/488.1; 428/913; 428/914

[58] Field of Search ..... 428/195, 321.3, 913, 428/914, 323, 327–329, 331, 484, 488.1, 488.4; 426/207

[56] References Cited

U.S. PATENT DOCUMENTS

| | | | |
|---|---|---|---|
| 4,476,179 | 10/1984 | Moriguchi et al. | 428/321.3 |
| 4,612,243 | 9/1986 | Shimazaki et al. | 428/321.3 |
| 4,624,891 | 11/1986 | Sato et al. | 428/321.3 |

*Primary Examiner*—John E. Kittle
*Assistant Examiner*—P. R. Schwartz
*Attorney, Agent, or Firm*—Oblon, Fisher, Spivak, McClelland & Maier

[57] ABSTRACT

A thermosensitive image transfer recording medium comprising a support material and a thermofusible ink layer formed thereon, comprising an image gradation control agent, a coloring agent and a carrier material for holding the coloring agent at normal temperatures and to carry the coloring agent, upon application of heat, out of said thermofusible ink layer for image formation, all of which are contained in a fine porous resin structure.

26 Claims, 4 Drawing Sheets

THERMOSENSITIVE IMAGE TRANSFER RECORDING MEDIUM

BACKGROUND OF THE INVENTION

The present invention relates to a thermosensitive image transfer recording medium capable of yielding images with high thermal sensitivity and with excellent image gradation on a receiving sheet by application of heat to a thermofusible ink layer of the recording medium through a thermal head or the like so as to imagewise transfer a coloring agent contained in the ink layer to the receiving sheet, thereby forming recorded images on the receiving sheet. More particularly, the present invention relates to a thermosensitive image transfer recording medium comprising a support material and a thermofusible ink layer formed thereon, which thermofusible ink layer comprises an image gradation control agent, a coloring agent and a carrier material, all of which are contained in a fine porous resin structure.

Conventionally, there are known a thermosensitive image transfer sheet comprising a support material and a sublimable dye layer formed on the support material, and a thermosensitive image transfer sheet comprising a support material and a thermofusible ink layer comprising a thermofusible material and a pigment, capable of forming images on a receiving sheet by subjecting the thermosensitive image transfer medium to thermal printing.

However, the method which uses a sublimable dye is superior in image gradation reproduction, but is low in thermal sensitivity and has the drawback of inferior durability of the image. On the other hand, the method which uses a thermofusible material and a pigment is superior in thermosensitivity and the durability of the produced images, but has the drawback of providing poor image gradation.

SUMMARY OF THE INVENTION

It is therefore an object of the present invention to provide a thermosensitive image transfer medium which is superior in thermosensitivity and which especially can produce a high density image with superior image gradation.

In the present invention, this object is accomplished by a thermosensitive image transfer medium comprising a support material and a thermofusible ink layer formed thereon, which thermofusible ink layer comprises an image gradation control agent, a coloring agent and a carrier material, all of which are contained in a fine porous resin structure.

DETAILED DESCRIPTION OF THE PREFERRED EMBODIMENTS

In the present invention, it is considered that a coloring agent is firmly held by means of a network structure of an image gradation control agent in a fine porous resin structure, so that when heat is applied by means of a thermal head or the like, the coloring agent seeps from the network structure of the image gradation control agent, then seeps from the fine pores of the resin to gradually permeate a receiving sheet. The volume of the coloring agent which seeps out varies with the amount of thermal energy applied by the thermal head or similar device. Therefore, the volume of the coloring agent transferred can be varied by control of the amount of thermal energy applied, and an image can be reproduced with faithful and wide range image gradation.

The amount of thermal energy applied also varies in accordance with the kinds of materials employed in the thermosensitive image transfer recording material and the thickness of the thermofusible ink layer.

Figure 1:
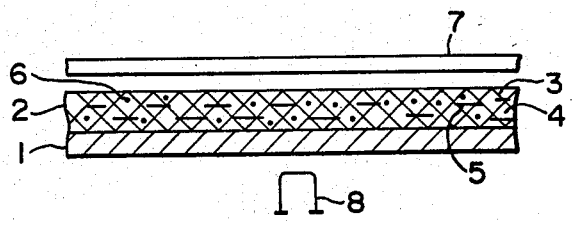
FIG. 1 is a cross-sectional schematic illustration of an embodiment of a thermosensitive image transfer recording material according to the present invention.

By referring to FIG. 1, the structure of an embodiment of a thermosensitive image transfer recording medium according to the present invention will now be explained.

In the figure, a thermofusible ink layer 2 is formed on a support material 1. The thermofusible ink layer 2 comprises a carrier material 4, an image gradation control agent dispersed in the form of a network, and a coloring agent 6, all of which are contained in a fine porous resin structure 3 made of a resin. An image receiving sheet 7 is superimposed on the surface of the thermofusible ink layer 2 and thermal energy is applied to the support material 1, opposite to the thermofusible ink layer 2, through a thermal head 8. It is considered that, upon application of heat, the coloring agent 6 seeps from the network structure of the image gradation control agent 5, then seeps from the fine porous resin structure 3 to gradually permeate the receiving sheet 7, so that a transferred image is formed on the receiving sheet 7.

As the support material 1, a variety of films and papers can be used which are conventionally employed in the field of thermosensitive recording. More specifically, heat resistant plastic films made of polyester, polycarbonate, triacetylcellulose, nylon or polyimide, cellophane, condenser paper and parchment paper are prferably employed as the support material 1. When a thermal head is employed as heat application device, it is preferable that the thickness of the support material 1 be about 2 to 15 μm. By contrast, when laser beams are employed as heat application source, the thickness of the support material is not always restricted to the above mentioned range.

When a thermal head is employed, the heat resistance of the support material can be improved by coating the side of the support material which comes into contact with the thermal head with a heat resistant protective layer comprising, for instance, silicone resin, fluorine-contained resin, polyimide resin, epoxy resin, phenolic resin, melamine resin, nitrocellulose or a thermosetting acrylic resin.

As a resin which is formed into a fine porous resin structure, thermoplastic resins and thermosetting resins can be employed.

Specific examples of the thermoplastic resins are homopolymers and copolymers of vinyl chloride, vinyl acetate, vinylidene chloride, acrylic acid, methacrylic acid, acrylic ester and methacrylic acid ester.

Specific examples of the thermosetting resins are one or more resins made from phenol, furan, formaldehyde, urea, melamine, alkyd, unsaturated polyester and epoxy.

In particular, thermosetting resins having high melting points are preferable for forming a fine porous resin structure, since they are resistant to heat and can be maintained firmly fixed to the support material even if they are heated to high temperatures (for instance, 300° C. or more) for obtaining high image gradation.

It is preferable that the average surface pore diameter of the fine porous resin structure be 10 μm or less.

The image gradation control agent for use in the present invention is firmly held within the fine porous resin structure and functions to precisely control the thermal transfer of the coloring agent which is held within the thermofusible carrier material. Therefore, it is preferable that the image gradation control agent be more wetting and more compatible with the resin of which the fine porous resin structure is formed than to the carrier material, and the previously mentioned auxiliary material, such as an oil or a material having a low melting point. It is considered that the image gradation control agent precisely controls the surface pore diameter of the fine porous resin structure so as to make the pore diameter small. Therefore, it is considered that when thermal energy is applied to the image gradation control agent, the image gradation control agent remains in the fine porous resin structure, without being transported outside the porous resin structure, thereby controlling the amount of the coloring agent held within the carrier material. Therefore, as such image gradation control agents, any materials can be employed as long as they work in the above-described manner. Specific emxamples of such image gradation control agents may be, but not restricted to, the folowing:

(I) Needle-like Pigments and Finely-divided Particles

As image gradation control agents for use in the present invention, from the viewpoint of the shape, needle-like pigments which form a network and finely-divided particles which form a stone wall structure can be employed.

(I)-a Needle-like Pigments

As such needle-like pigments, not only inorganic pigments, but also organic pigments can be employed as long as they are in the form of needles and can constitute a network in the thermofusible ink layer 2.

Specific examples of such needle pigments are ochre, Chrome Yellow G, Phthalocyanine pigments such as Phthalocyanine Blue, Lithol Red, BON Maroon Light, terra abla, needle zinc oxide, 2,7-bis[2-hydroxy-3-(2-chlorophenylcarbamoyl)naphthalene-1-ylazo]-9-fluorenone, 4', 4''-bis [2-hydroxy-3-(2,4-dimethylphenyl)carbamoylnaphthalene-1-ylazo]-1,4-distyrylbenezene.

It is preferable that such needle-like pigments be 0.3 to 3 μm long and not more than 0.5 μm wide and thick. Further, it is preferable that the amount of the above needle-like pigments be 0.1 to 10 parts by weight, more preferably 0.5 to 5 parts by weight, to 1 part by weight of the coloring agent.

(I)-b Finely-divided Particles

As finely-divided particles for use in the present invention, not only inorganic particles, but also organic particles can be employed as long as they can constitute a stone wall structure in the thermofusible ink layer 2.

Specific examples of such finely-divided particles are finely-divided inorganic particles of metal oxides such as zinc oxide, tin oxide and aluminum oxide, finely-divided particles of metals such as aluminum, copper and cobalt (occasionally these can be employed in the form of foil), finely-divided organic particles of diatomaceous earth, Molecular Sieves, phenolic resin, epoxy resin, carbon black. The above can be used alone or in combination.

All of the above finely-divided particles have good coagulation performance. Of the above particles, carbon black is particularly preferable for use in the present invention since it is excellent in coagulation performance. Carbon black is usually used as black pigment. In the present invention, however, it works as a medium from which the ink components seep out when the viscosity thereof is reduced upon application of heat thereto. Therefore, carbon black is not transferred together with the ink components to the receiving sheet, but remains in the image transfer recording medium.

In the present invention, it is preferable that the particle size of the above finely-divided particles be in the range of 0.01 μm to 200 μm in order to successfully attain the function of image gradation control agent and to obtain high quality images.

In the present invention, no special coating method is required to form a stone wall structure when the above finely-divided particles are employed.

It is preferable that the amount of the image gradation control agents which belong to the above (I) be 1 to 80 wt. %, more preferably 5 to 40 wt. %, to the entire weight of the ink compositions in the thermofusible ink layer. Further, it is preferable that the ratio by wright of the image gradation control agent to the resin of the fine porous resin structure be in the range of 0.05 to 2.0, more preferably in the range of 0.1 to 1.0.

(II) Chemical Compounds

As further image gradation control agents for use in the present invention, from the viewpoint of the chemical structure, the compounds having the following formulas can be employed.

(II)-a Perylene Type Compounds (I)

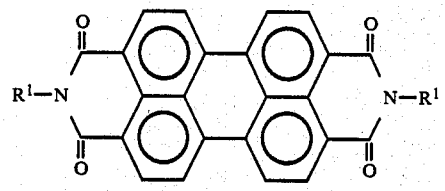

(II)

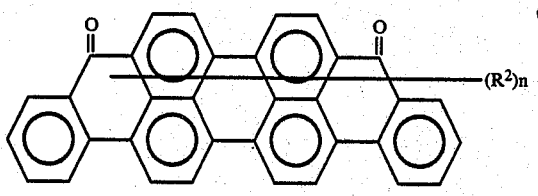

-continued (III)

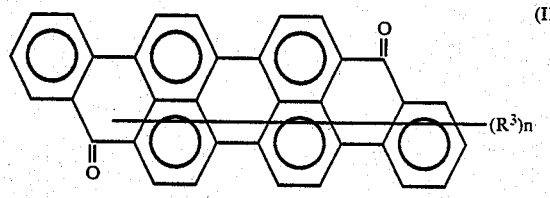

wherein $R^1$ represents hydrogen, an unsubstituted or substituted alkyl group or an unsubstituted or substituted aryl group; $R^2$ and $R^3$ each represent an unsubstituted or substituted alkyl or alkoxy group, halogen or a nitro group; n is an integer of 0, 1, 2, 3 or 4.

Specific example of the perylene compounds are as follows:

No. 1

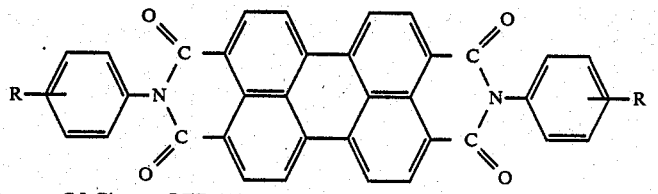

C.I. Pigment RED 123 (Sumitomo Fast Brill. Red 213, Sumitomo)

No. 2

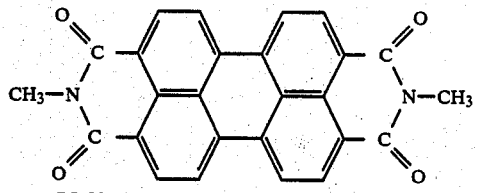

C.I. Vat Red 123 (Paliogen Maroon G, BASF)

No. 3

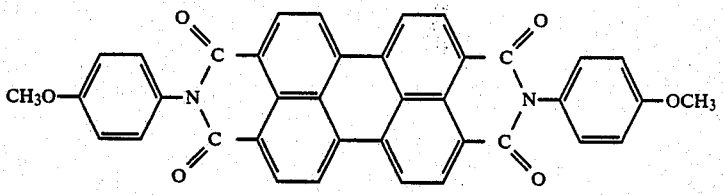

C.I. Vat Red 29 (Sumitomo Fast Red 3Br, Sumitomo)

No. 4

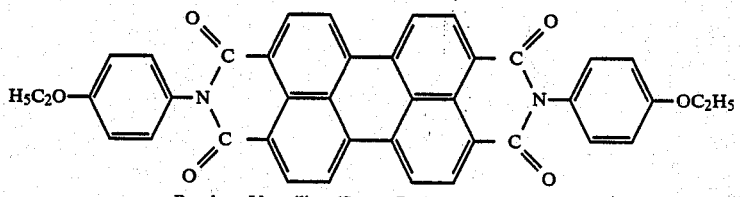

Perylene Vermilion (Sanyo Red B-G 511, Sanyo)

No. 5

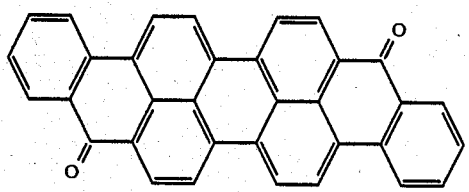

C.I. Vat Violet 10 (Benzadon Violet B, TDC)

-continued

No. 6

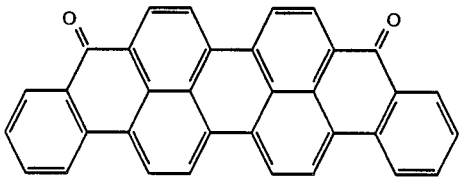

C.I. Vat Blue 20 (Ind. Dark Blue BOA, BASF)

No. 7

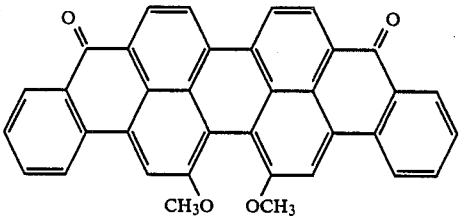

C.I. Vat Green (Ind. Brill. Green B, BASF)

No. 8

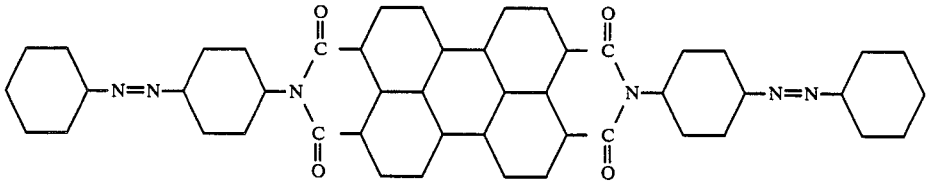

C.I. Pigment Red 178 (Paliogen Red 3910, BASF)

No. 9

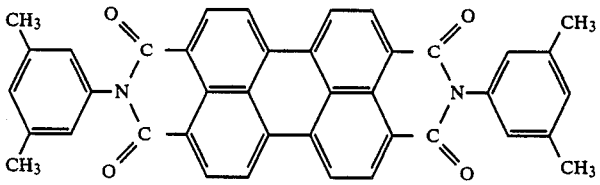

C.I. Pigment Red 149 (Paliogen Red K3580, BASF)

(II)-2 Phthalocyanine Type Compounds

Metal-free phthalocyanine, metal-free phthalocyanine derivatinves, metal phthalocyanine and metal phthalocyanine derivatives can be employed. Specific examples of the phthalocyamine type compounds are, not restricted to, the following:

No. 1

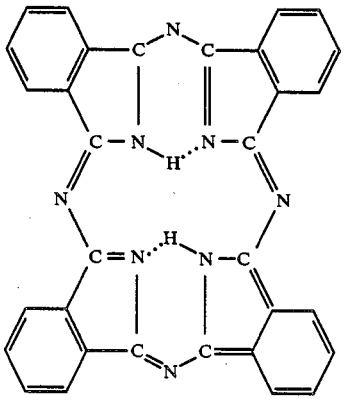

No. 2

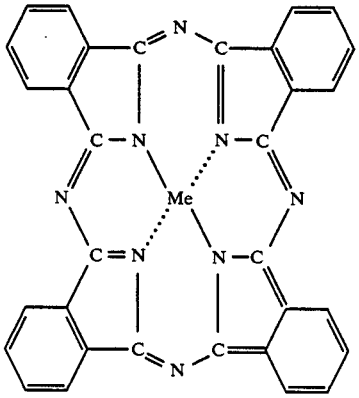

-continued
No. 3
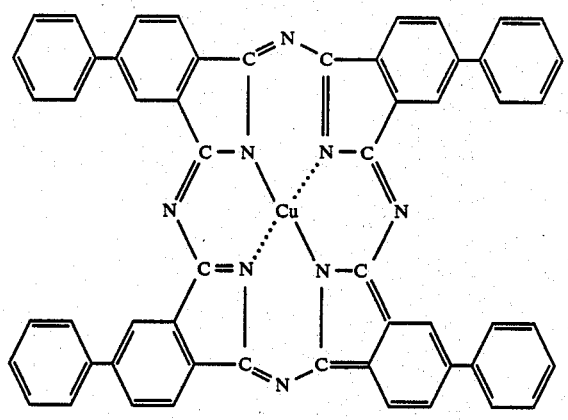
No. 4
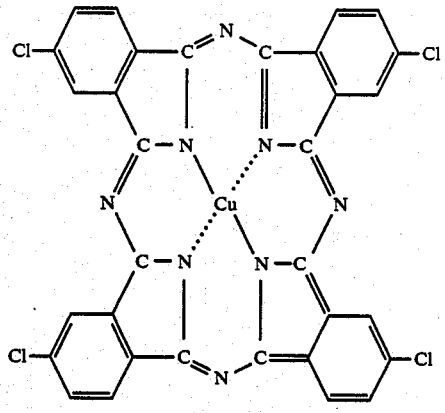
No. 5
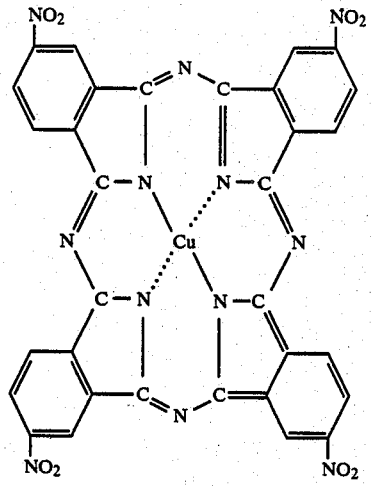
No. 6
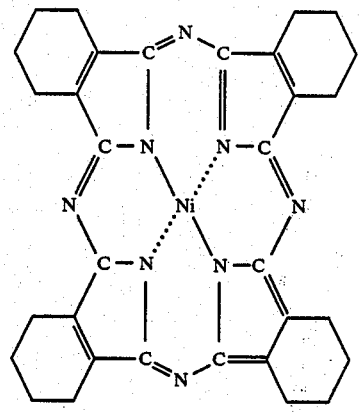
No. 7
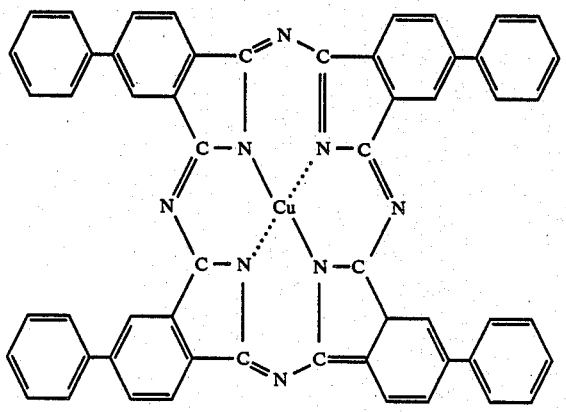
No. 8
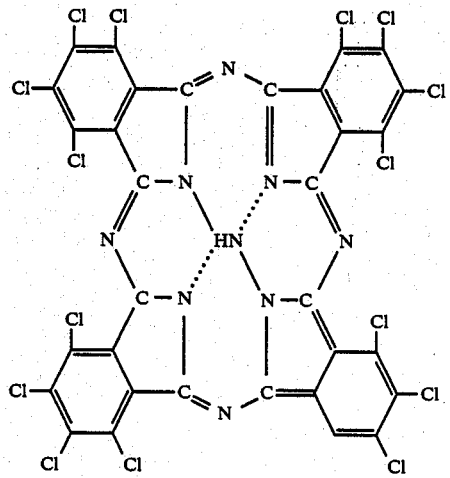

-continued
No. 9
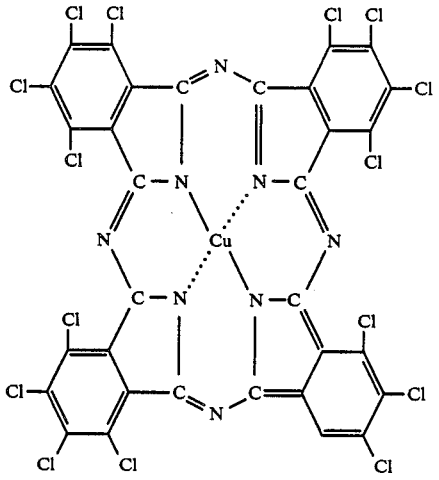
No. 10
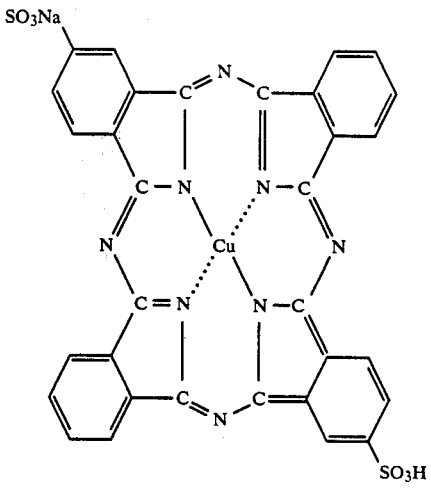
No. 11
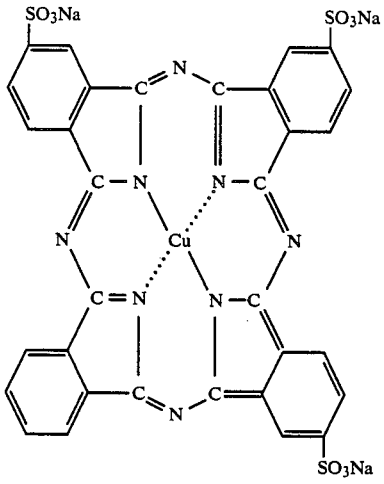
No. 12
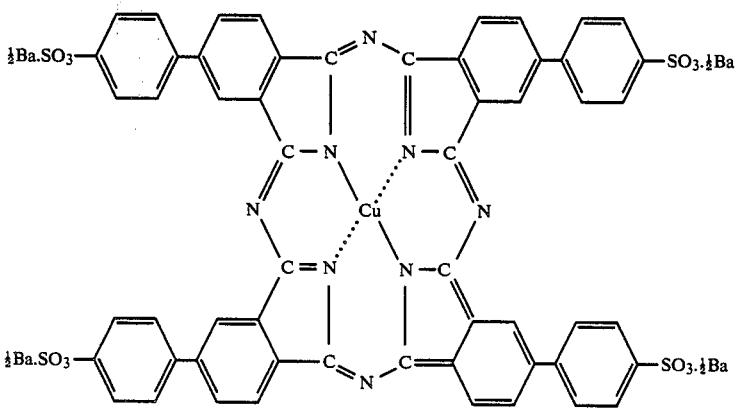

-continued

No. 13

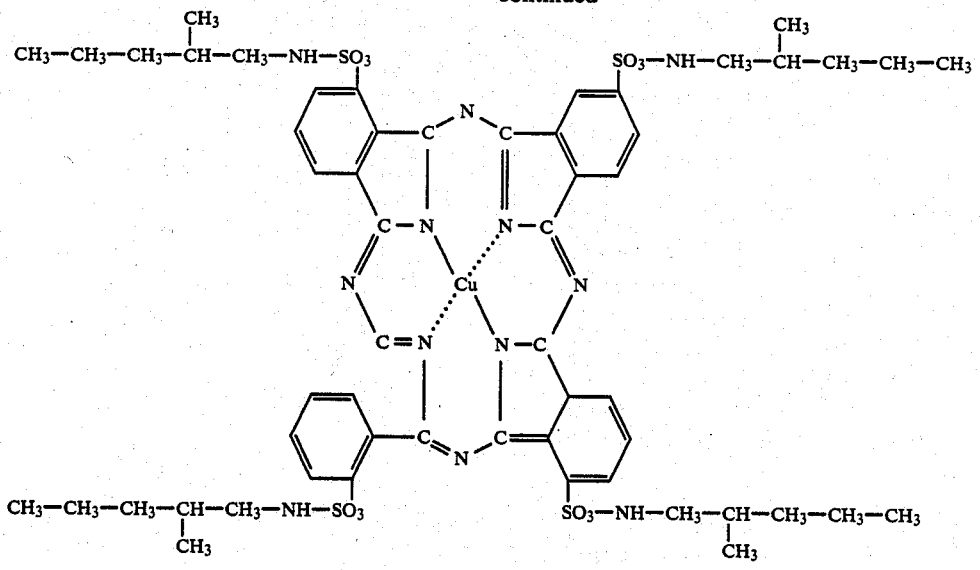

It is preferably that the amount of the above image gradation control agent be 0.1 to 10 parts by weight, more preferably 0.3 to 5 parts by weight, to 1 part by weight of a coloring agent in the thermofusible ink layer.

(II)-3 Azo Compounds

Azo compounds having the following general formula:

$$X\text{-}(N{=}N{-}Y)_n$$

wherein X represents a dizaonium salt radical, Y represents a coupler radicala, and n is an integer of 1, 2 or 3.

Specific examples of the axo compounds are as follows:

No. 1

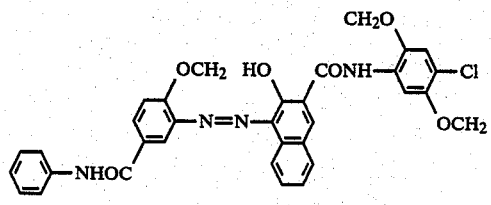

No. 2

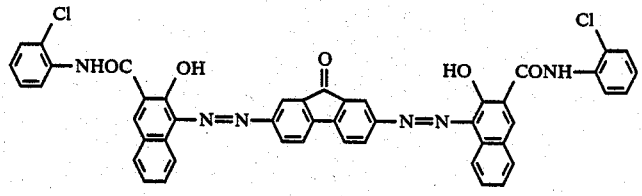

No. 3

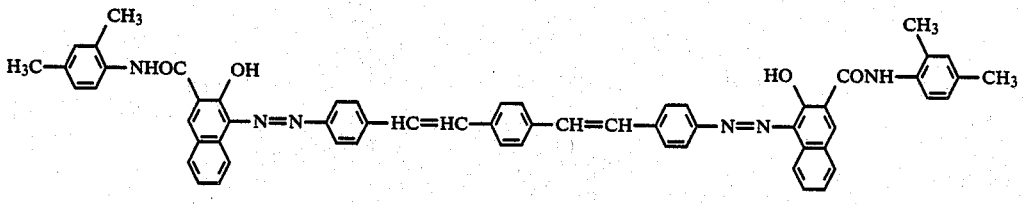

No. 4

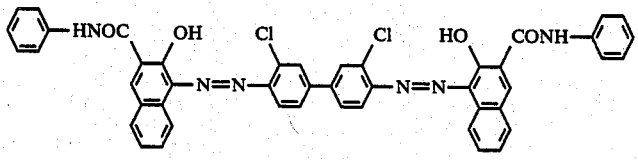

-continued
No. 5
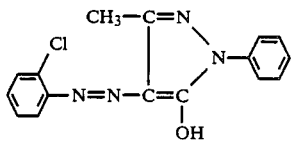
No. 6
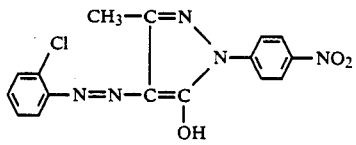
No. 7
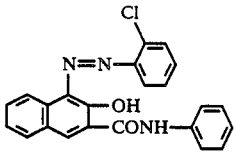
No. 8
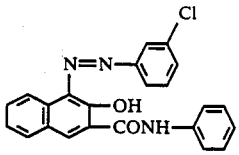
No. 9
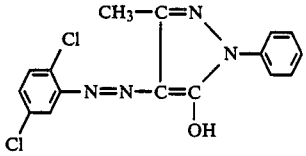
No. 10
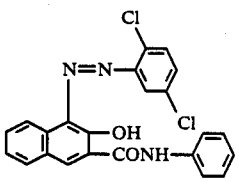
No. 11
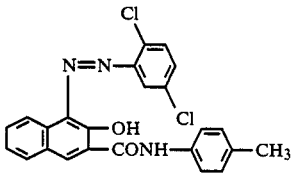
No. 12
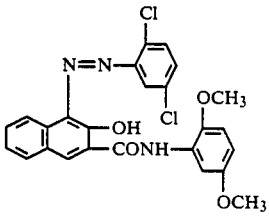
No. 13
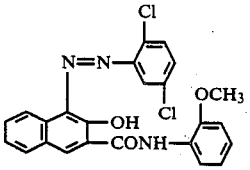
No. 14
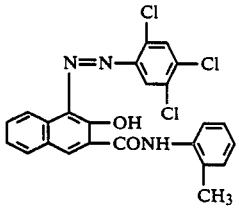
No. 15
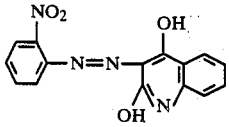
No. 16
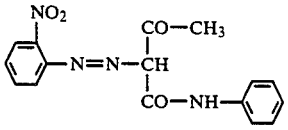
No. 17
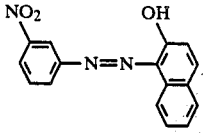
No. 18
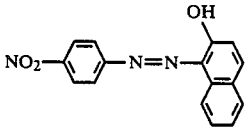
No. 19
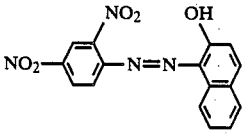
No. 20
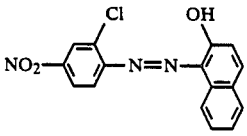
No. 21
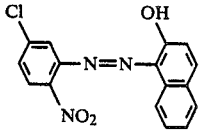
No. 22
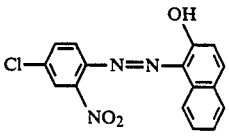
No. 23
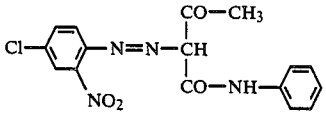
No. 24
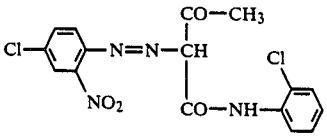

-continued
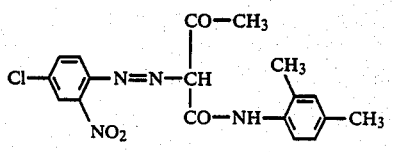
No. 25
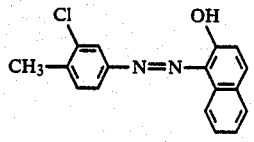
No. 26
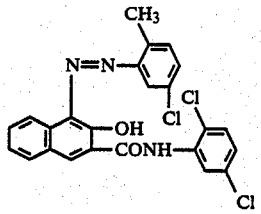
No. 27
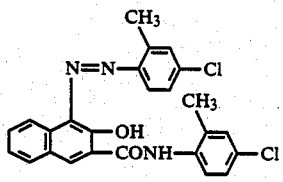
No. 28
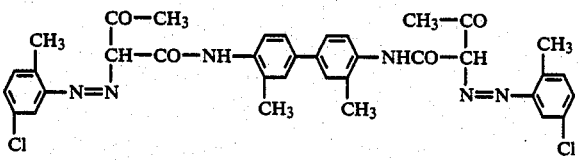
No. 29
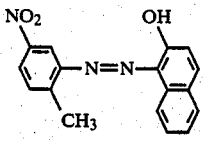
No. 30
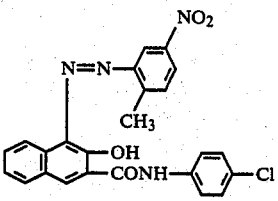
No. 31
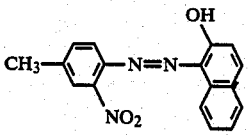
No. 32
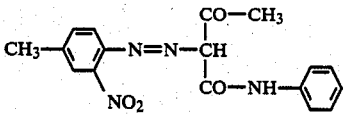
No. 33
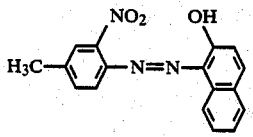
No. 34
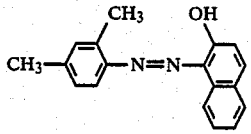
No. 35
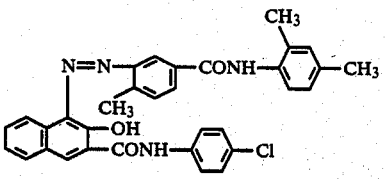
No. 36
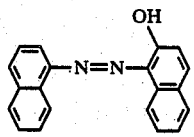
No. 37
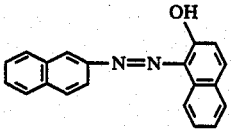
No. 38
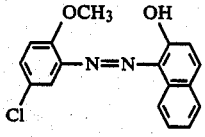
No. 39
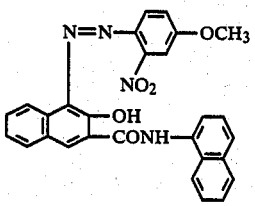
No. 40
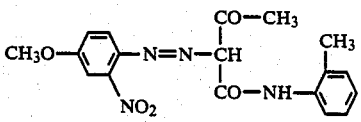
No. 41

-continued
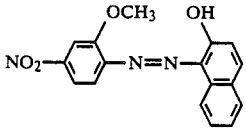
No. 42
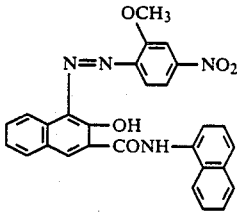
No. 43
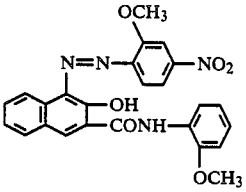
No. 44
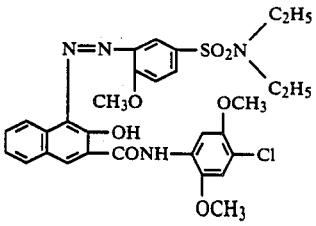
No. 45
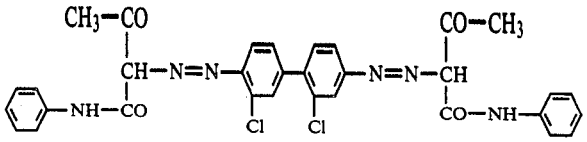
No. 46
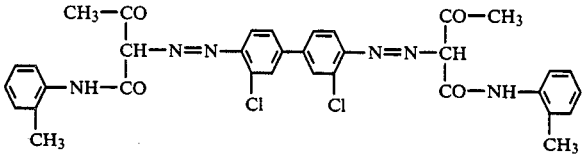
No. 47
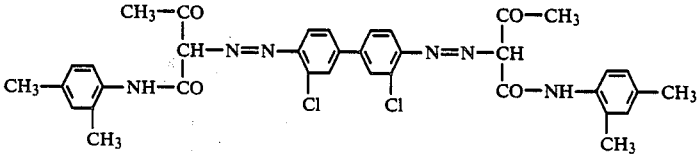
No. 48
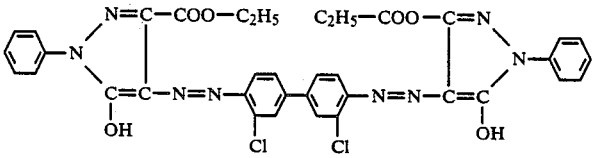
No. 49
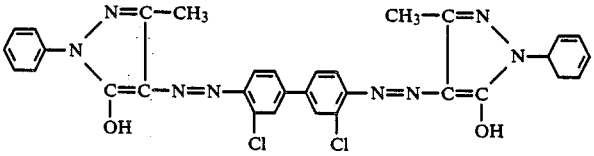
No. 50
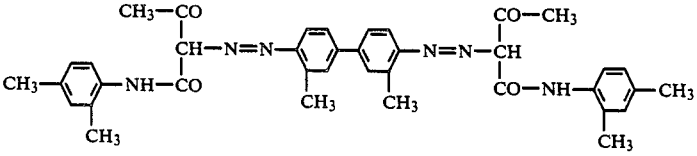
No. 51
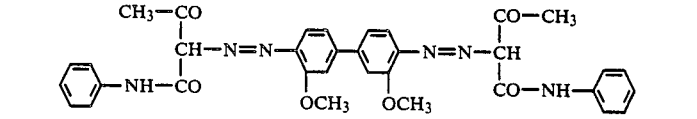
No. 52

-continued

No. 53

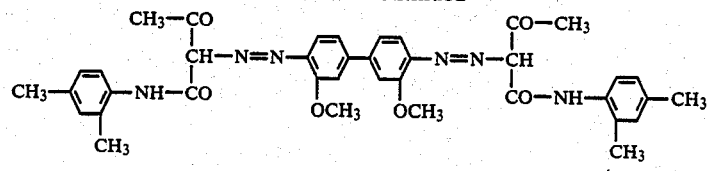

No. 54

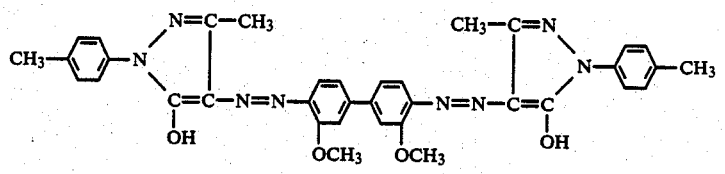

No. 55

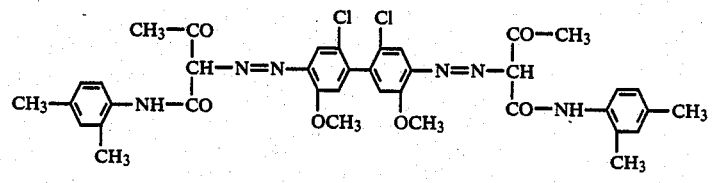

No. 56

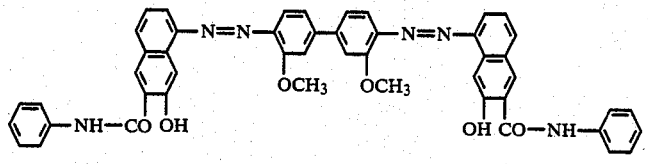

No. 57

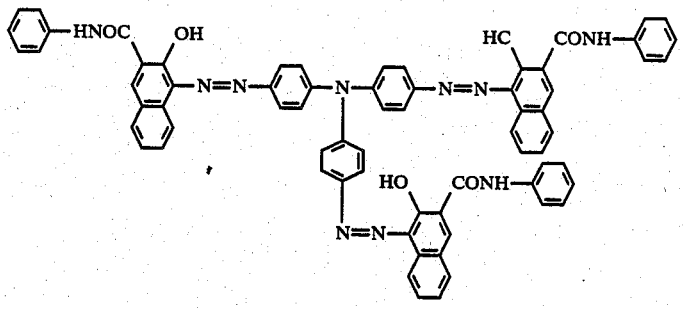

It is preferable that the amount of the above image gradation control agent be 0.1 to 10 parts by weight, more preferably 0.3 to 5 parts by weight, to 1 part by weight of a coloring agent in the thermofusible ink layer.

Of the above listed image gradation control agents (II)-1, (II)-2 and (II)-3, the image gradation control agents of (II)-3, in particular, disazo type pigments are preferably for use in the present invention.

As the coloring agents for use in the present invention, the following dyes and pigments are preferably for use in obtaining images with excellent image gradation;

Examples of such dyes are direct dyes, acid dyes, basic dyes, mordant dyes, sulfur dyes, building dyes, azoic dyes, oil dyes and thermosublimable disperse dyes.

Specific examples of the above dyes are as follows:

(1) Direct Dyes

Direct Sky Blue and Direct Black W (2) Acid Dyes

Tartrazine, Acid Violet 6B and Acid Fast Red 3G (3) Basic Dyes

Safranine, Auramine, Crystal Violet, Methylene Blue, Rhodamine B and Victoria Blue B.

(4) Mordant Dyes

Sunchromine Fast Blue MB, Eriochrome Azurol B and Alizarin Yellow (5) Sulfur Dyes Sulphur Brillilanlt Green 4G (6) Building, i.e. Vat, Dyes Indanthrene Blue (7) Azoic Dyes Napthol AS (9) Oil Dyes Nigrosine, Spirit Black EB, Varifast Orange 3206, Oil Black 215, Butter Yellow, Sudan Blue II, Oil Red B and Rhodamine B (9) Disperse Dyes (9-1) Monoazo Disperse Dyes: Disperse Fast Yellow G, Disperse Fast Yellow 5G, Disperpse Fast Yellow 5R and Disperse Fast Red R;

(9-2) Anthraquinone Disperse Dyes: Disperse Fast Violet OR, Disperse Fast Violet B, Disperse Blue Extra and Disperse Fast Brilliant Blue B; and (9-3) Nitrodiphenylamine Disperse Dyes; Disperse Fast Yellow RR and Disperse Fast Yellow GL One of the advantages of the present invention is that disperse dyes which are not thermosublimable (that is disperse dyes having high melting points) can be employed.

It is preferable that the particle sizes of these dyes be smaller than those of the previously mentioned image gradation control agents. Further, it is preferably that the above dyes be in a dissolved state.

It is also preferable that the raito by weight of the image gradation control agent to the coloring agent be 0.5 or more.

Further in the present invention, a finely-divided pigment can also be employed as the coloring agent. As such a finely-divided pigment, it is preferable that the particle size be not more than 1.0 μm, more preferably not more than 0.5 μm, after sufficient dispersion.

Specific examples of such finely-divided pigments are the following pigments which are commercially available from Hoechst:

Permanent Yellow GG 02 (C.I. Pigment Yellow 17),

Permanent Yellow DHG trans (02 C.I. Pigment Yellow 12),

Novoperm Yellow HR 03 (C.I. Pigment Yellow 83),

Hansa Brilliant Yellow 5GX 02 (C.I Pigment Yellow 74),

Permanent Orange RL 01 (C.I. Pigment Orange 34),

Novoperm Red HFG (C.I. Pigment Orange 38),

Novoperm Red HFT (C.I. Pigment Red 175),

Permanent Lake Red LCLL 02 C.I. Pigment Red 53:1),

Novoperm Red HF 4B (C.I. Pigment Red 187),

Permanent Carmine FBB02 (C.I. Pigment Red 146),

Permanent Rubine L 6B (C.I. Pigment Red 57:1),

Hostaperm Pink E trans (C.I. Pigment Red 122), and

Reflex Blue R 50 (C.I. Pigment Blue 61)

Further, oil-soluble phthalocyanine dyes can be employed as the coloring agent. Oil-soluble phthalocyanine dyes have the particular advantages over other dyes, for instance, of yielding clear images with excellent image gradation and durability since the amount of the dye transferred is proportional to the amount of thermal energy applied.

As cyan coloring agents, oil-soluble phthalocyanine dyes represented by the following general formula are particularly preferable for use in the present invention:

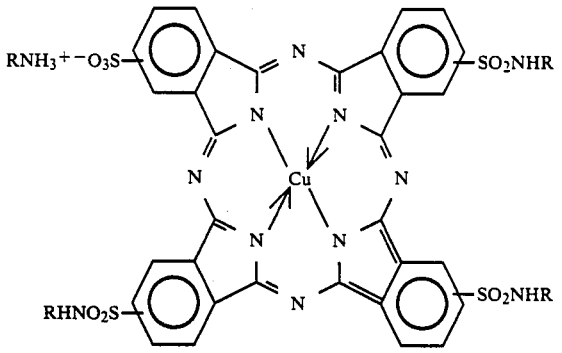

where R represents hydrogen, an unsubstituted or substituted alkyl group or aryl group.

Specific examples of the above dyes are as follows, which are commercially avialable with the following trade marks:

(1) Dyes commercially available from BASF.

Zapon Fast Blue HFL (C.I. s 74350),
Neozapon Blue 806 (C.I. 74-350),
Neozapon Blue 807 (C.I. 74-400), and
Neptune Blue 722 (Solvent Blue 722)

(2) Dye commerically available from Du Pont

Luxol Fast Blue MBS (3) Dye commercially available from Bayer

Sirius Light Turcuoise Blue FBL (4) Dyes commerically available from Hodogaya Chemical Co., Ltd.

Spilon Blue GNH,
Spilon Blue 2BNH

It is preferable that the particle sizes of the above dyes be smaller than those of the previously mentioned image gradation control agents. Further, it is preferable that the above dyes be in a dissolved state.

As magenta and yellow coloring agents, oil-soluble metal-containing dyes can also be empolyed in the present invention.

Specific examples of such magenta and yellow oil-soluble phthalocyanine dyes are as follows:

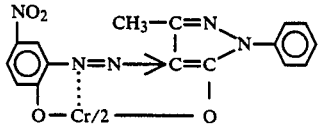

No. 1

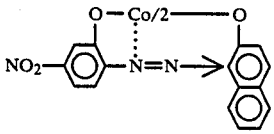

No. 2

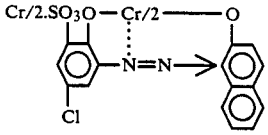

No. 3

-continued

No. 4

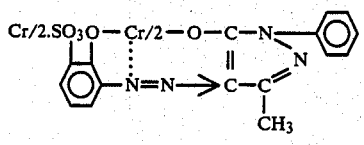

No. 5

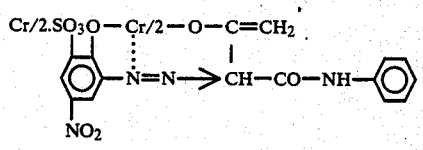

No. 6

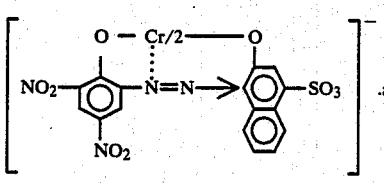

.amine salt

No. 7

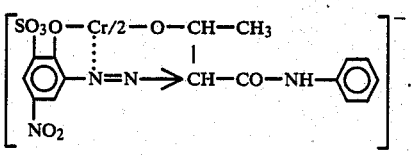

.[Rhodamine B extra]+

No. 8

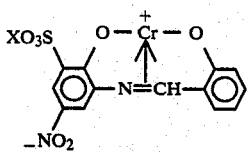

wherein X is sodium or other alkali metal

No. 9

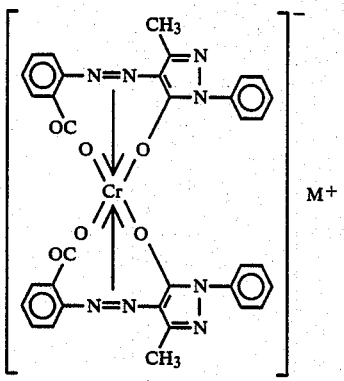

wherein M is sodium or other alkali metal

Commercially available examples of the above oil-soluble phthalocyanine dyes are as follows:

TABLE 1

ZAPON Series (manufactured by BASF)

| Commercial Name | C.I. Index(II) | | Complex Metal | Type of Dye |
|---|---|---|---|---|
| Zapon Fast Yellow G | 48045 | 1:1 | Chrome Complex | Azomethine |
| Zapon Fast Yellow GR | 13900A | 1:1 | Chrome Complex | Azo |
| Zapon Fast Yellow R | 18690 | 1:2 | Chrome Complex | Azo |
| Zapon Fast Yellow 3RE | 11700 | 1:2 | Cobalt Compex | Azo |
| Zapon Fast Orange G | 18745A | 1:1 | Chrome Complex | Azo |
| Zapon Fast Orange RR | 18736A | 1:1 | Chrome Compex | Azo |

TABLE 1-continued

ZAPON Series (manufactured by BASF)

| Commercial Name | C.I. Index(II) | | Complex Metal | Type of Dye |
|---|---|---|---|---|
| Zapon Fast Red GE | 12716 | 1:2 | Chrome Complex | Azo |
| Zapon Fast Fire Red B | 13900 + 45170 | 1:1 | Chrome Complex | Rhodamine Color Lake |
| Zapon Fast Red BE | 12715 | 1:2 | Chrome Complex | Azo |
| Zapon Fast Red 3B | 16260 + 45170 | 1:1 | Chrome Complex Copper Complex | Rhodamine Color Lake |
| Zapon Fast Green HLK | 48045 + 74350S | 1:1 | Chrome Complex Copper Complex | Azo/ Phtha-locyanine |
| Zapon Fast Black B | 12195 | 1:2 | Chrome Complex | Azo |
| Zapon Fast Black RE | S12195 | 1:2 | Chrome Complex | Azo |
| Zapon Fast Brown BE | S12195 | 1:2 | Cobalt Complex | Azo |

TABLE 2

NEOZAPON Dyes

| Commercial Name | Type of Complex | Color Index (I) | (II) |
|---|---|---|---|
| Neozapon Yellow GG | 1:1 Chrome | Solvent Yellow 79 | |
| Neozapon Yellow GR | 1:1 Chrome | Solvent Yellow 81 | 13900:1 |
| Neozapon Yellow R | 1:2 Chrome | Solvent Yellow 82 | 18690 (Conversion Product) |
| Neozapon Orange G | 1:1 Chrome | Solvent Orange 56 | 18745:1 |
| Neozapon Orange RG | 1:2 Chrome | Solvent Orange 54 | — |
| Neozapon Orange 3R | 1:2 Chrome | Solvent Orange 70 | — |
| Neozapon Red GE | 1:2 Chrome | Solvent Red 122 | 12716 (Conversion Product) |
| Neozapon Fire Red G | 1:2 Chrome Color Lake | Solvent Red 119 | — |
| Neozapon Fire Red BL | 1:2 Chrome Color Lake | Solvent Red 160 | — |
| Neozapon Red BE | 1:2 Cobalt | Solvent Red 118 | 15675 (Conversion Product) |
| Neozapon Brown BE | 1:2 Cobalt | Solvent Brown 58 | — |
| Neozapon Brown 6R | Metal Complex Mixture | — | — |
| Neozapon Black RE | 1:2 Cobalt | Solvent Black 27 | 12195 (Conversion Product) |
| Neozapon Black L | | | |

In addition to the above, Spilon Yellow GRLH Special, Spilon Red GRLT Special, Zizen Spilon S.P.T. Orange 6 (commercially available from Hodogaya Chemical Co., Ltd.) and Alizarin Red (commercially available from Hoechst) can also be employed in the present invention.

It is preferable that the particle sizes of the above dyes be smaller than those of the previously mentioned image gradation control agents which constitute, for example, a network structure. Further, it is preferable that the above dyes be in a dissolved state.

Further in the present invention, as yellow and magenta coloring agents, monoazo dyes selected from the previously mentioned azo pigments which work as image gradation agents are preferable for use in the present invention:

In particular, the following monoazo dyes are useful when used in combination with the previously mentioned bisazo dyes which work as image gradation agents.

Commercially available examples of the above monoazo dyes are as follows:

(1) Sico Fast Yellow D 1355 (manufactured by BASF)

(2) Sico Fast Yellow D 1250 (manufactured by BASF)

(3) Lake Red LC (manufactured by Hoechst)

The above monoazo dyes have the following formula:

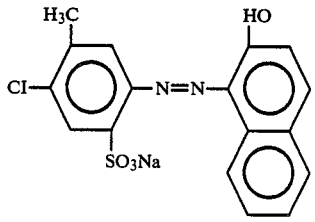

(4) Lake Red C 405 (manufactured by Dainichi Seika Color and Chemicals Mfg. Co., Ltd.)

(5) Fast Red 1547 (manufactured by Dainichi Seika Color and Chemicals Mfg. Co., Ltd.)

The above monoazo dyes have the following general formula:

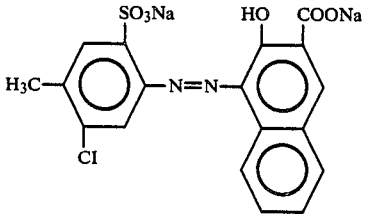

It is preferable that the particle size of these coloring agents be smaller than the particle size of the image gradation control agent which constitutes a network structure. Further it is preferable that these coloring agents be in a well-dispersed state.

A carrier material for use in the present invention serves to hold the coloring agents in the thermofusible ink laer at normal temperatures and to melt upon application of heat to carry the coloring agent out of the porous resin structure for image formation.

As the carrier materials for use in the present invention, any thermofusible solid materials can be employed as long as the materials are incompatible with the resin of the fine porous resin structure.

As such carrier materials, materials that are employed as thermofusible binders in conventional thermosensitive image transfer materials can be employed. Specific examples are as follows: waxes such as carnauba wax, paraffin wax, microcystalline wax and castor wax; higher fatty acids, metal salts and esters of higher fatty acids such as stearic acid, palmitic acid, lauric acid, aluminum stearate, lead stearate, barium stearate, zinc stearate, zinc palmitate, methylhydroxy stearate, glycerol monohydroxy stearate; homopolymers and copolymers such as polycaprolactone, polyethylene, polypropylene, polyisobutylene, polyethylene wax, polyethylene oxide, polyfluoroethylene, ethylene-acrylic acid copolymer, ethylene - ethyl acrylate copolymer, ethylene-vinyl acetate copolymer. These materials can be employed either alone or in combination.

It is preferable that the above material be employed in an amount of 50 to 200 parts by weight to 100 parts by weight of the resin which constitutes the fine porous resin structure.

One of the key features of the present invention is that the thermofusible ink layer comprises a fine porous resin structure. In order to form the fine porous resin structure, an auxiliary oil component which has a small campatibility with the resin of the porous resin structure is employed. Whether or not such an auxuliary oil component remains in the final product of the thermosensitive image transfer recording material according to the present invention depends upon the kinds and properties of the ink layer compositions.

As such auxiliary oil components, for example, lanolin fatty acid, metal salts of lanolin fatty acid or esters of lanolin fatty acid are preferable for use in the present invention.

The effectiveness of the metal salts and esters of lanolin fatty acid for the formation of the porous resin structure is considered to be attributable to the properties that they are slightly capable or substantially noncompatible with the resin of the fine porous resin structure and are excellent in wetting capability with the coloring agents and dispersability.

Lanolin fatty acid for use in the present invention comprises a hydroxylated fatty acid and anti-iso fatty acid having 13 to 33 carbon atoms.

As the metal salts of the lanolin fatty acid, for example, sodium salt, potassium salt, calcium salt, magnesium salt, barium salt, zinc salt, lead salt, manganese salt, iron salt, nickel salt, cobalt slat and aluminum salt can be employed.

Further as the esters of lanolin, for example, esters of methyl alcohol, ethyl alcohol, butyl alcohol, glycerin, pentaerythritol, polypropylene glycol and trimethylolpropane can be employed. These esters can be employed alone or in combination with the above-mentioned metal salts.

Of the above lanolin derivatives, pentaerythritol monoester of lanolin fatty acid, pentaerythritol triester of lanolin fatty acid and trimethylolpropanol ester of lanolin fatty acid are particularly preferable for use in the present invention.

Commercially available products containing the above metal salts of lanolin fatty acid are Neocoat ES-181, ES-183, LFC-50M and LS-3102MB (manufactured by Furukawa Seiiyu Co., Ltd.). In addition to the above, vegetable oils and animal oils such as cotton oil, rape oil, whale oil and lard, and mineral oils such as motor oil, spindle oil, dynamo oil and vaseline, can be employed.

The thermofusible ink layer formed as outlined above is usually prepared by, but is not restricted to, the following method. Specifically, an image gradation control agent, a control agent, a carrier and an auxiliary material which has a small compatibility with the resin of which the fine porous structure is made, are mixed and dispersed in a suitable organic solvent using a dispersion device such as an attritor and ball mill to obtain an ink dispersion (or solution). A solution of the resin dissolved in an organic solvent is prepared separately and mixed together with the previously obtained ink dispersion. The mixture is then uniformly dispersed using a blender such as a ball mill. Next, the dispersion is applied to the support material. The above-mentioned fine porous thermofusible ink layer is formed on the support material by drying the applied dispersion.

For example, a humectant and a dispersing agent may be added to the above dispersion to facilitate the dispersing of the image gradation control agent, coloring agent and carrier. In addition, a commonly used filler may be added, as required, to the above dispersion.

An alternative method of preparing the thermofusible ink layer is that a material, which is not compatible with the resin constituting the fine porous resin structure and which is soluble in a solvent which will not dissolve the resin, is kneaded together with the resin, the kneaded mixture is applied to the surface of a support material to form a resin layer, the first mentioned material is then dissolved in the solvent to leave the fine porous resin structure, and the above-mentioned ink components are then filled into the porous resin structure, whereby a thermofusible ink layer is obtained which has the similar characteristics as outlined above. In this case, it is preferable that the ratio by weight of the resin to the non-compatible material be 3.0 or less.

It is preferable that the thickness of the thermofusible ink layer be 2 to 30 μm, more preferably 4 to 10 μm.

In order to more firmly fix the above described porous resin structure and the image gradation control agent on the support material, an intermediate layer can be formed on the support material, so that the thermofusible ink layer is formed on the intermediate layer. Such an intermediate layer can be made of a plastic resin or a filler-containing plastic resin. It is preferable that the thickness of the intermediate layer be 1 to 3 μm.

As the receiving sheet to be used in combination with the thermosensitive image transfer recording medium according to the present invention, conventional plain paper and synthetic paper can be employed. In order to facilitate the transfer of the coloring agent from the image transfer recording medium to the receiving sheet, it is preferable that filler such as the above-mentioned resins, $TiO_2$, silica or ZnO be contained in such papers.

By referring to the following examples, the present invention will now be explained more specifically:

EXAMPLE 1-1A

(1) Preparation of Thermomsensitive Image Transfer Recording Medium No. 1-1A A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoly) naphthalene-1-ylazo]-9-fluorenone (Image Gradation Control Agent) | 5 |
| Modified lanolin oil | 30 |
| Mixture of carnauba wax and paraffin wax (1:1) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |

-continued

| | Part by Weight |
|---|---|
| Toluene | 130 |

To the above dispersion, 300 parts by weight of a 20 wt. % vinyl chloride-vinyl acetate copolymer solution (comprising vinyl chloride-vinyl acetate copolymer, tlluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated by a wire bar on the front side of a polyester film backed with a silicone resin heat resistant layer, having a thickness of 6 μm, and was then dried at 100° C. for 1 minute, so that a thermofusible ink layer having a thickness of about 5 μm was formed on the polyester film, whereby a thermosensitive image transfer recording medium No. 1-1A according to the present invention was prepared. The average pore diameter in the surface of the thermofusible ink layer was determined by use of a microscope. In this recording medium, the ratio by weight of the image gradation control agent to the coloring agent was 0.5.

(2) Image Transfer Tests by Use of Thermosensitive Image

Transfer Recording Medium No. 1-1A

Image Transfer Recording Medium No. 1-1 was superimposed on a sheet of plain paper in such a manner that the thermofusible ink layer came into close contact with the plain paper. A thermal head was then applied to the back side of the image transfer recording medium, with the applied thermal energy per dot varied to 1 mJ, 2 mJ and 3 mJ, so that the image densities of the respective images obtained were measured by a Macbeth densitometer. From the gradient of the obtained image densities/applied thermal energies, the image gradation was determined.

EXAMPLE 1-1B

Example 1-1A was repeated except that the amount of the image gradation control agent was increased to 10 parts by weight, whereby a thermosensitive image transfer recording medium No. 1-1B according to the present invention was prepared. In this recording medium, the ratio by weight of the image gradation control agent to the coloring agent was 1. The average surface pore diameter of the thermofusible ink layer was determined in the same manner as in Example 1-1B. The image gradation was also obtained in the same manner as in Example 1-1A.

EXAMPLE 1-1C

Example 1-1A was repeated except that the amount of the image gradation control agent was increased to 20 parts by weight, whereby a thermosensitive image transfer recording medium No. 1-1C according to the present invention was prepared. In this recording medium, the ratio by weight of the image gradation control agent to the coloring agent was 2. The average surface pore diameter of the thermofusible ink layer was determined in the same manner as in Example 1-1A. The image gradation was also obtained in the same manner as in Example 1-1A.

COMPARATIVE EXAMPLE 1-1

Example 1-1 was repeated except that the image gradation control agent was not employed, whereby a comparative thermosensitive image transfer recording medium No. 1-1 was prepared. In this recording medium, the ratio by weight of the image gradation control agent to the coloring agent was 0. The average surface pore diameter of the thermosensitive ink layer was determined in the same manner as in Example 1-1A. The image gradation was also obtained in the same manner as in Example 1-1A.

Figure 2:
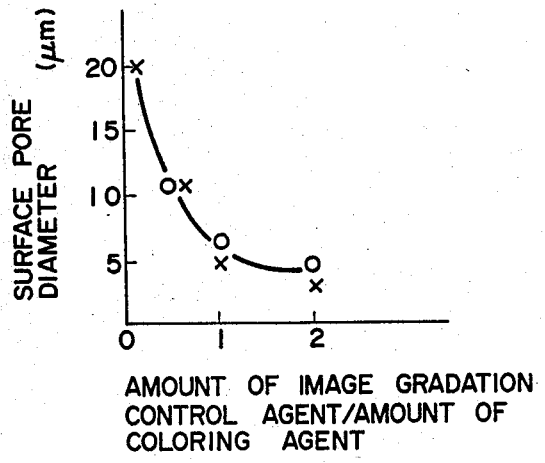
FIG. 2 is a graph showing the relationship between (a) the ratio of the amount of an image gradation control agent to the amount of a coloring agent contained in a thermofusible ink layer and (b) the surface pore diameter of the thermofusible ink layer.

FIG. 2 shows the relationship between (a) the quantity ratio of the image gradation control agent/coloring agent and (b) the surface pore diameter of the thermofusible ink layer, which were obtained by use of the thermosensitive image transfer recording mediums Nos. 1-1A to 1-1C according to the present invention and the comparative thermosensitive image transfer recording medium No. 1-1.

Figure 3:
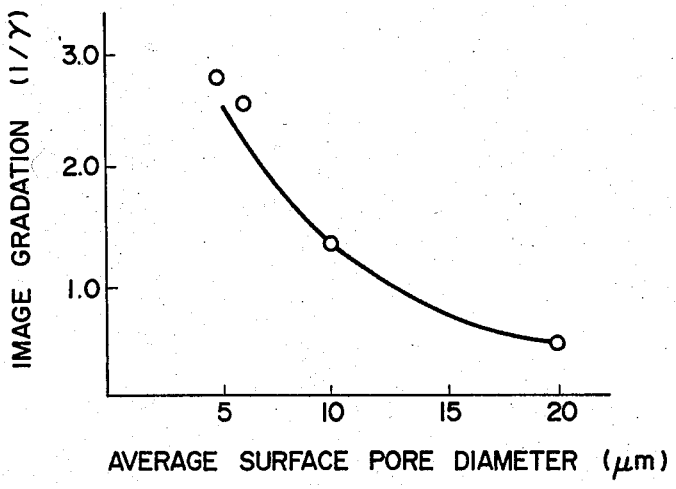
FIG. 3 is a graph showing the relationship between the surface pore diameter of the thermofusible ink layer and the image gradation in FIG. 2.

FIG. 3 shows the relationship between (a) the average surface pore diameter of the thermofusible ink layer and the image gradation ($1/\gamma$), which were obtained by use of the thermosensitive image transfer recording mediums Nos. 1-1A to 1-1C according to the present invention and the comparative thermosensitive image transfer recording medium No. 1-1.

The results shown in FIGS. 2 and 3 indicate that in order to obtain an image gradation of 1.0 or more, it is necessary that the average surface pore diameter of the thermofusible ink layer be not more than 10 μm, and that in order to attain this, it is necessary that the ratio by weight of the image gradation control agent/coloring agent be 0.5 or more.

EXAMPLE 1-2A

(1) Preparation of Thermosensitive Image Transfer Recording Medium No. 1-2A

A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil (Carrier Material) | 30 |
| Mixture of carnauba wax and paraffin wax (1:1) | 30 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 1-2A according to the present invention was prepared. The average pore diameter at the surface of the thermofusible ink layer was determined by use of a microscope. In this recording medium, the ratio by weight of the modified lanolin oil to the wax mixture was 1.0.

(2) Image Transfer Tests by Use of Thermosensitive Image Transfer Recording Medium No. 1-2A Image Transfer Recording Medium No. 1-2A was superimposed on a sheet of plain paper in such a manner that the thermofusible ink layer came into close contact with the plain paper. A thermal head was then applied to the back side of the image transfer recording medium, with the applied thermal energy per dot varied to 1 mJ, 2 mJ and 3 mJ, so that the image densities of the respective images obtained were measured by a Macbeth densitometer. From the gradient of the obtained image densities/applied thermal energies the obtained image densities, the image gradation was determined.

EXAMPLE 1-2B

Example 1-2A was repeated except that the amount of the modified lanolin oil to the wax mixture was increased to 60 parts by weight, whereby a thermosensitive image transfer recording medium No. 1-2B according to the present invention was prepared. In this recording medium, the ratio by weight of the modified lanolin oil to the wax mixture was 2. The average surface pore diameter of the thermofusible ink layer was determined in the same manner as in Example 1-2A. The image gradation was also obtained in the same manner as in Example 1-2A.

EXAMPLE 1-2C

Example 1-2A was repeated except that the amount of the modified lanolin oil to was increased to 90 parts by weight, whereby a thermosensitive image transfer recording medium No. 1-2C according to the present invention was prepared. In this recording medium, the ratio by weight of the modified lanolin oil to the wax mixture was 3. The average pore diameter of the thermofusible ink layer was determined in the same manner as in Example 1-2A. The image gradation was also obtained in the same manner as in Example 1-2A.

EXAMPLE 1-2D

Example 1-2A was repeated except that the amount of the modified lanolin oil to was increased to 150 parts by weight, whereby a thermosensitive image transfer recording medium No. 1-2D according to the present invention was prepared. In this recording medium, the ratio by weight of the modified lanolin oil to the wax mixture was 5. The average pore diameter of the thermofusible ink layer was determined in the same manner as in Example 1-2A. The image gradation was also obtained in the same manner as in Example 1-2A.

COMPARATIVE EXAMPLE 1-2

Example 1-2A was repeated except that the modified lanolin oil was not employed, whereby a comparative thermosensitive image transfer recording medium No. 1-2 was prepared. In this recording medium, the ratio by weight of the modified lanolin oil to the wax mixture was 0. The average pore diameter of the thermosensitive ink layer was determined in the same manner as in Example 1-4. The image gradation was also obtained in the same manner as in Example 1-1A.

Figure 4:
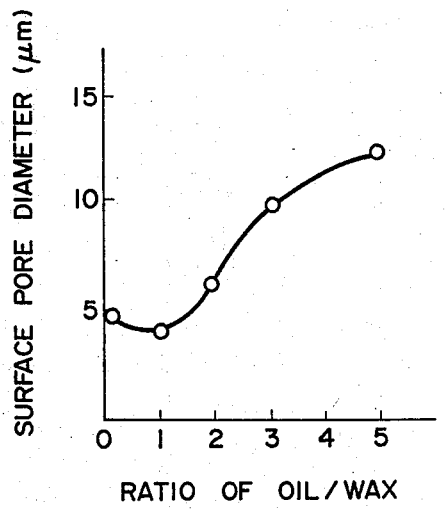
FIG. 4 is a graph showing the relationship between (a) the ratio of a wax to an oil contained in a thermofusible ink layer and (b) the surface pore diameter of the thermofusible ink layer.

FIG. 4 shows the relationship between (a) the ratio of the modified lanolin oil/the wax mixture and (b) the average surface pore diameter of the thermofusible ink layer, which were obtained by use of the thermosensitive image transfer recording mediums Nos. 1-2A to 1-2D according to the present invention and the comparative thermosensitive image transfer recording medium No. 1-2.

Figure 5:
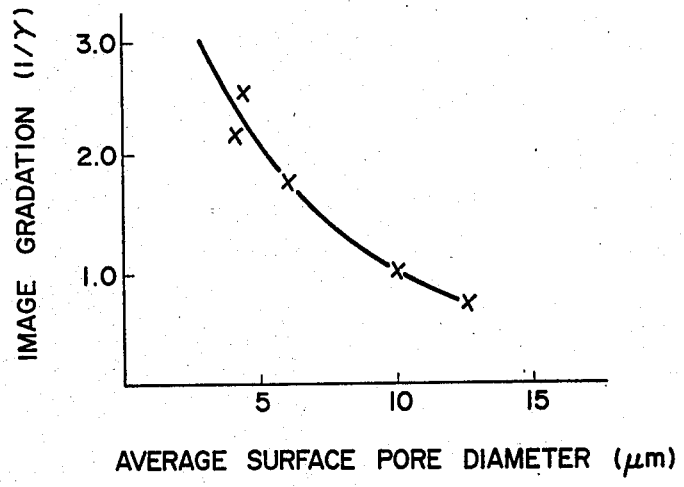
FIG. 5 is a graph showing the relationship between the surface pore diameter of the thermofusible ink layer in FIG. 4 and the image gradation.

FIG. 5 shows the relationship between (a) the average surface pore diameter of the thermofusible ink layer and (b) the image gradation, which were obtained by use of the thermosensitive image transfer recording mediums Nos. 1-2A to 1-2D according to the present invention and the comparative thermosensitive image transfer recording medium No. 1-2.

The results shown in FIGS. 4 and 5 indicate that in order to obtain an image gradation of 1.0 or more, it is necessary that the average pore diameter of the thermofusible ink layer be not more than 10 μm, and that in order to attain this, it is necessary that the ratio by weight of the image gradation control agent/coloring agent be 0.5 or more.

EXAMPLE 1-3

A mixture of the following components was dispersed in a ball mill at 68° C. for about 48 hours:

| | Part by Weight |
|---|---|
| Sudan Red 460 (Coloring Agent) (manufactured by BASF) | 10 |
| Finely-divided carbon black particles (Image Gradation Control Agent) | 10 |
| Modified lanolin oil | 30 |
| Carnauba wax (Carrier Material) | 20 |
| Paraffin wax | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % epoxy resin solution (comprising epoxy resin, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 1-3 according to the present invention was prepared.

Thermal printing was performed using this image transfer recording mediums in the same manner as in Example 1-1A. As a result, magenta images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.10 | 0.22 | 0.38 | 0.51 | 0.68 | 0.71 | 0.90 | 0.99 | 1.03 |

As shown above, the image density varied in accordance with the variation of the amount of the applied thermal energy, indicating the availability of image density gradation suitable for use in practice.

COMPARATIVE EXAMPLE 1-3A

Example 1-3A was repeated except that the carbon black powder was eliminated from the formulation of Example 1-3, whereby a comparative thermosensitive image transfer recording medium No. 1-3A having a thermofusible ink layer with a thickness of 5 μm was prepared. Thermal printing was performed using this comparative thermosensitive image transfer recording medium in the same manner as in Example 1-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.15 | 0.60 | 0.87 | 1.05 |

As shown in the above, the image density varied in accordance with the variation of the amount of the applied thermal energy. However, the image density gradation was not suitable for use in practice.

COMPARATIVE EXAMPLE 1-3B

Example 1-3 was repeated except that the epoxy resin solution employed in Example 1-3 was not employed, whereby a comparative thermosensitive image transfer recording medium No. 1-3B having a thermofusible ink layer with a thickness of 5 μm was prepared. Thermal printing was performed using this comparative thermosensitive image transfer recording medium in the same manner as in Example 1-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.14 | 0.73 | 0.95 | 1.00 |

As shown in the above, the image density varied in accordance with the variation of the amount of the applied thermal energy. However, the image density gradation was not suitable for use in practice.

COMPARATIVE EXAMPLE 1-3C

Thermal printing was performed using a commercially available thermosensitive image transfer recording ribbon comprising a support material and a thermofusible ink layer containing a wax component and a magenta pigment, having a thickness of about 5 μm (manufactured by Fuji Kagakushi Kogyo Co., Ltd.) in the same manner as in Example 1-1A. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.25 | 1.01 | 0.95 | 1.20 |

As shown in the above, the image density varied in accordance with the variation of the amount of the applied thermal energy. However, the image density gradation was not suitable for use in practice.

EXAMPLE 1-4

Example 1-3 was repeated except that Sudan Red 460 (coloring agent) employed in Example 1-3 was replaced by Sudan Blue 670 (manufactured by BASF), so that a thermosensitive image transfer recording material No. 1-4 according to the present invention was prepared. Thermal printing was performed using this thermosensitive image transfer recording material in the same manner as in Example 1-1A, so that cyan images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 0.98 | 1.04 | 1.10 |

COMPARATIVE EXAMPLE 1-4A

Example 1-4 was repeated except that the carbon black powder was eliminated from the formulation of Example 1-4, whereby a comparative thermosensitive image transfer recording medium No. 1-4 having a thermofusible ink layer with a thickness of 5 μm was preprared. Thermal printing was performed using this comparative thermosensitive image transfer recording medium in the same manner as in Example 1-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.18 | 0.45 | 0.88 | 1.12 |

As shown in the above, the image density varied in accordance with the variation of the amount of the applied thermal energy. However, the image density gradation was not suitable for use in practice.

COMPARATIVE EXAMPLE 1-4B

Example 1-4 was repeated except that the epoxy resin solution employed in Example 1-4 was not employed, whereby a comparative thermosensitive image transfer recording medium No. 1-4B having a thermofusible nk layer with a thickness of 5 μm was prepared. Thermal printing was performed using this comparative thermosensitive image transfer recording medium in the same manner as in Example 1-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.20 | 0.50 | 0.89 | 1.09 |

As shown in the above, the image density varied in accordance with the variation of the amount of the applied thermal energy. However, the image density gradation was not suitable for use in practice.

EXAMPLE 1-5

Example 1-3 was repeated except that Sudan Red 460 and the finely-divided carbon black particles employed in Example 1-3 were respectively replaced by Sudan Yellow 150 (manufactured by BASF) and finely-divided zinc oxide particles, so that a thermosensitive image transfer recording material No. 1-5 according to the present invention was prepared. Thermal printing was performed using this thermosensitive image transfer recording material in the same manner as in Example 1-1A, so that yellow images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.19 | 0.35 | 0.50 | 0.70 | 0.78 | 0.85 | 0.92 | 1.00 |

COMPARATIVE EXAMPLE 1-5A

Example 1-5 was repeated except that the finely-divided zinc oxide was eliminated from the formulation of Example 1-5, whereby a comparative thermosensitive image transfer recording medium No. 1-5A having a thermofusible ink layer with a thickness of 5 μm was prepared. Thermal printing was performed on this comparative thermosensitive image transfer recording medium in the same manner as in Example 1-5. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.10 | 0.52 | 0.82 | 1.01 |

As shown in the above, the image density varied in accordance with the variation of the amount of the applied thermal energy. However, the image density gradation was not suitable for use in practice.

COMPARATIVE EXAMPLE 1-5B

Example 1-5 was repeated except that the epoxy resin solution employed in Example 1-5 was not employed, whereby a comparative thermosensitive image transfer recording medium No. 1-5B having a thermofusible ink layer with a thickness of 5 μm. Thermal printing was performed using this comparative thermosensitive image transfer recording medium in the same manner as in Example 1-5. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.09 | 0.45 | 0.75 | 0.95 |

As shown in the above, the image density varied in accordance with the variation of the amount of the applied thermal energy. However, the image density gradation was not suitable for use in practice.

EXAMPLE 1-6

A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoyl)naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % epoxy resin solution (comprising epoxy resin, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 1-6 according to the present invention was prepared.

Thermal printing was performed using this thermosensitive image transfer recording medium in the same manner as in Example 1-1A. As a result, magenta images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.32 | 0.50 | 0.64 | 0.80 | 0.92 | 1.09 | 1.21 | 1.17 |

As shown above, the image density varied in accordance with the variation of the amount of the applied thermal energy, indicating the availability of image density modulations suitable for practical use.

COMPARATIVE EXAMPLE 1-6A

Example 1-6 was repeated except that 2,7-bis[2-hydroxy-3-(2-chlorophenylcarbamoyl)naphthalene-1-ylazo]-9fluorenone serving as image gradation control agent was eliminated from the formulation of Example 1-6, whereby a comparative thermosensitive image transfer recording medium No. 1-6A having a thermofusible ink layer with a thickness of 5 μm was prepared. Thermal printing was performed using this comparative thermosensitive image transfer recording medium in the same manner as in Example 1-6. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.20 | 0.65 | 1.95 | 1.15 |

As shown in the above, the image density varied in accordance with the variation of the amount of the applied thermal energy. However, the image density gradation was not suitable for use in practice.

COMPARATIVE EXAMPLE 1-6B

Example 1-6 was repeated except that the epoxy resin solution employed in Example 1-6 was not employed, whereby a comparative thermosensitive image transfer recording medium No. 1-6B having a thermofusible ink layer with a thickness of 5 μm was prepared. Thermal printing was performed using this comparative thermosensitive image transfer recording medium in the same manner as in Example 1-6. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.15 | 0.75 | 1.00 | 1.05 |

As shown in the above, the image density varied in accordance with the variation of the amount of the applied thermal energy. However, the image density gradation was not suitable for use in practice.

EXAMPLE 1-7

Example 1-6 was repeated except that Sudan Red 460 employed in Example 1-6 was replaced by Sudan Blue 670, whereby a thermosensitive image transfer recording medium No. 1-7 according to the present invention was prepared. Thermal printing was performed using this thermosensitive image transfer recording medium in the same manner as in Example 1-6, so that cyan images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|

-continued

| | | | | | | | | | |
|---|---|---|---|---|---|---|---|---|---|
| Image Density | 0.09 | 0.21 | 0.38 | 0.55 | 0.75 | 0.81 | 0.98 | 1.04 | 1.10 |

As shown above, the image density varied in accordance with the variation of the amount of the applied thermal energy, indicating the availability of image density modulations suitable for practical use.

COMPARATIVE EXAMPLE 1-7A

Example 1-7 was repeated except that 2,7-bis[2-hydroxy-3-(2-chlorophenylcarbamoyl)naphthalene-1-ylazo]-9-fluorenone serving as image gradation control agent was eliminated from the formulation of Example 1-7, whereby a comparative thermosensitive image transfer recording medium No. 1-7 having a thermofusible ink layer with a thickness of 5 μm. Thermal printing was performed using this comparative thermosensitive image transfer recording medium in the same manner as in Example 1-7. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.18 | 0.45 | 0.88 | 1.12 |

As shown in the above, the image density varied in accordance with the variation of the amount of the applied thermal energy. However, the image density gradation was not suitable for use in practice.

COMPARATIVE EXAMPLE 1-7B

Example 1-7 was repeated except that the epoxy resin solution employed in Example 1-7 was not employed, whereby a comparative thermosensitive image transfer recording medium No. 1-7B having a thermofusible ink layer with a thickness of 5 μm. Thermal printing was performed on this comparative thermosensitive image transfer recording medium in the same manner as in Example 1-7. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.20 | 0.50 | 0.89 | 1.09 |

As shown in the above, the image density varied in accordance with the variation of the amount of the applied thermal energy. However, the image density gradation was not suitable for use in practice.

EXAMPLE 1-8

Example 1-6 was repeated except that Sudan Red 460 employed in Example 1-6 was replaced by Sudan Yellow 150 (manufactured by BASF), whereby a thermosensitive image transfer recording medium No. 1-8 according to the present invention was prepared. Thermal printing was performed using this thermosensitive image transfer recording medium in the same manner as in Example 1-6, so that yellow images were obtained.

The relationship between the applied thermal energies and the obtained image densities was as follows:

| | | | | | | | | | |
|---|---|---|---|---|---|---|---|---|---|
| Thermal Energy (mJ/dot) | 0.4 | 0.6 | 0.8 | 1.0 | 1.2 | 1.4 | 1.6 | 1.8 | 2.0 |
| Image Density | 0.08 | 0.19 | 0.35 | 0.50 | 0.70 | 0.78 | 0.85 | 0.92 | 1.00 |

As shown above, the image density varied in accordance with the variation of the amount of the applied thermal energy, indicating the availability of image density gradation suitable for practical use.

COMPARATIVE EXAMPLE 1-8A

Example 1-8A was repeated except that 2,7-bis[2-hydroxy-3-(2-chlorophenylcarbamoyl)naphthalene-1-ylazo]-9-fluorenone serving as image gradation control agent was eliminated from the formulation of Example 1-8, whereby a comparative thermosensitive image transfer recording medium No. 1-8A having a thermofusible ink layer with a thickness of 5 μm. Thermal printing was performed using this comparative thermosensitive image transfer recording medium in the same manner as in Example 1-8. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.10 | 0.52 | 0.82 | 1.01 |

As shown in the above, the image density varied in accordance with the variation of the amount of the applied thermal energy. However, the image density gradation was not suitable for use in practice.

COMPARATIVE EXAMPLE 1-8B

Example 1-8 was repeated except that the epoxy resin solution employed in Example 1-8 was not employed, whereby a comparative thermosensitive image transfer recording medium No. 1-8B having a thermofusible ink layer with a thickness of 5 μm. Thermal printing was performed using this comparative thermosensitive image transfer recording medium in the same manner as in Example 1-8. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.09 | 0.45 | 0.75 | 1.09 |

As shown in the above, the image density varied in accordance with the variation of the amount of the applied thermal energy. However, the image density gradation was not suitable for use in practice.

EXAMPLE 1-9

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Needle-like zinc oxide (Image Gradation Control Agent) | 15 |
| Machine oil | 20 |
| Carnauba wax (Carrier Material) | 20 |
| Caster wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 4 |
| Methyl ethyl ketone | 100 |
| Toluene | 130 |

To the above dispersion, 300 parts by weight of a 20 wt. % furan resin solution (comprising furan resin, toluene and methyl ethyl ketone, with the mixing ratio thereof being 10:20:30) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 1-14 according to the present invention was prepared.

Thermal printing was performed using this thermosensitive image transfer recording medium in the same manner as in Example 1-1A, so that black images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.20 | 0.38 | 0.55 | 0.70 | 0.85 | 0.95 | 1.02 | 1.10 | 1.22 |

As shown above, the image density varied in accordance with the variation of the amount of the applied thermal energy, indicating the availability of image density gradation suitable for use in practice.

COMPARATIVE EXAMPLE 1-9A

Example 1-9 was repeated except that the needle-like zinc oxide serving as image gradation control agent was eliminated from the formulation of Example 1-9, whereby a comparative thermosensitive image transfer recording medium No. 1-9A having a thermofusible ink layer with a thickness of 5 μm was prepared. Thermal printing was performed using this comparative thermosensitive image transfer recording medium in the same manner as in Example 1-1A. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.22 | 0.80 | 1.10 | 1.15 |

As shown in the above, the image density varied in accordance with the variation of the amount of the applied thermal energy. However, the image density gradation was not suitable for use in practice.

COMPARATIVE EXAMPLE 1-9B

Example 1-9 was repeated except that the furan resin solution employed in Example 1-9 was not employed, whereby a comparative thermosensitive image transfer recording medium No. 1-9B having a thermofusible ink layer with a thickness of 4 μm was prepared. Thermal printing was performed using this comparative thermosensitive image transfer recording medium in the same manner as in Example 1-1A. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.23 | 0.78 | 1.12 | 1.18 |

As shown in the above, the image density varied in accordance with the variation of the amount of the applied thermal energy. However, the image density gradiation was not suitable for use in practice.

In the following Examples 2-1 through 2-4, as the image gradiation control agents, finely-divided particles were employed.

EXAMPLE 2-1

A mixture of the following components was dispersed in a ball mill at 68° C. for about 48 hours:

| | Part by Weight |
|---|---|
| Sudan Red 460 (Coloring Agent) (manufactured by BASF) | 10 |
| Carbon black (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 2-1 according to the present invention was prepared.

Thermal printing was performed using this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.10 | 0.22 | 0.38 | 0.50 | 0.68 | 0.71 | 0.90 | 0.99 | 1.03 |

As shown above, the image density varied in accordance with the variation of the amount of the applied thermal energy, indicating the availability of image density gradation suitable for use in practice.

COMPARATIVE EXAMPLE 2-1A

Example 2-1 was repeated except that carbon black serving as image gradation control agent was eliminated from the formulation of Example 2-1, whereby a comparative thermosensitive image transfer recording medium No. 2-1 having a thermofusible ink layer with a thickness of 5 μm was prepared. Thermal printing was performed using this comparative thermosensitive image transfer recording medium in the same manner as in Example 2-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.15 | 0.60 | 0.87 | 1.05 |

As shown in the above, the image density varied in accordance with the variation of the amount of the applied thermal energy. However, the image density gradation was not suitable for use in practice.

COMPARATIVE EXAMPLE 2-1B

Example 2-1 was repeated except that the vinyl chloride - vinyl acetate copolymer solution employed in Example 2-1 was eliminated from the formuation of Example 2-1, whereby a comparative thermosensitive image transfer recording medium No. 2-1B having a thermofusible ink layer with a thickness this comparative thermosensitive image transfer recording medium in the same manner as in Example 2-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.14 | 0.73 | 0.95 | 1.00 |

As shown in the above, the image density varied in accordance with the variation of the amount of the applied thermal energy. However, the image density gradation was not suitable for use in practice.

EXAMPLE 2-2

Example 2-1 was repeated except that Sudan Red 460 (coloring agent) employed in Example 2-1 was replaced by Sudan Blue 670 (manufactured by BASF), so that a thermosensitive image transfer recording material No. 2-2 according to the present invention was prepared. Thermal printing was performed using this thermosensitive image transfer recording material in the same manner as in Example 2-1, so that cyan images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 0.98 | 1.04 | 1.10 |

As shown above, the image density varied in accordance with the variation of the amount of the applied thermal energy, indicating the availability of image density gradation suitable for use in practice.

COMPARATIVE EXAMPLE 2-2A

Example 2-2 was repeated except that carbon black serving as needle-like image gradation control agent was eliminated from the formulation of Example 2-2, whereby a comparative thermosensitive image transfer recording medium No. 2-2A having a thermofusible ink layer with a thickness of 5 μm was prepared. Thermal printing was performed using this comparative thermosensitive image transfer recording medium in the same manner as in Example 2-2. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.18 | 0.45 | 0.88 | 1.12 |

As shown in the above, the image density varied in accordance with the variation of the amount of the applied thermal energy. However, the image density gradation was not suitable for use in practice.

COMPARATIVE EXAMPLE 2-2B

Example 2-2 was repeated except that the vinyl chloride - vinyl acetate copolymer solution employed in Example 2-2 was eliminated from the formuation of Example 2-2, whereby a comparative thermosensitive image transfer recording medium No. 2-2B having a thermofusible ink layer with a thickness of 5 μm was prepared. Thermal printing was performed using this comparative thermosensitive image transfer recording medium in the same manner as in Example 2-2. The relationship between the applied thermal energies and the obtained image densities was as follows:

| Thermal Energy (mJ/dot) | 0.4 | 0.6 | 0.8 | 1.0 |
|---|---|---|---|---|

-continued

| | | | | |
|---|---|---|---|---|
| Image Density | 0.20 | 0.50 | 0.89 | 1.09 |

As shown in the above, the image density varied in accordance with the variation of the amount of the applied thermal energy. However, the image density gradation was not suitable for use in practice.

EXAMPLE 2-3

Example 2-1 was repeated except that Sudan Red 460 (coloring agent) employed in Example 2-1 was replaced by Sudan Yellow 150 (manufactured by BASF), so that a thermosensitive image transfer recording material No. 2-3 according to the present invention was prepared. Thermal printing was performed using this thermosensitive image transfer recording material in the same manner as in Example 3-1, so that yellow images with the following excellent image gradation were obtained. The relationship between the applied thermal energies and the obtained image densities was as follows:

| | | | | | | | | | |
|---|---|---|---|---|---|---|---|---|---|
| Thermal Energy (mJ/dot) | 0.4 | 0.6 | 0.8 | 1.0 | 1.2 | 1.4 | 1.6 | 1.8 | 2.0 |
| Image Density | 0.08 | 0.19 | 0.35 | 0.50 | 0.70 | 0.78 | 0.85 | 0.92 | 1.00 |

As shown above, the image density varied in accordance with the variation of the amount of the applied thermal energy, indicating the availability of image density modulations suitable for practical use.

COMPARATIVE EXAMPLE 2-3A

Example 2-3 was repeated except that carbon black serving as image gradation control agent was eliminated from the formulation of Example 2-3, whereby a comparative thermosensitive image transfer recording medium No. 2-3A having a thermofusible ink layer with a thickness of 5 μm was prepared. Thermal printing was performed using this comparative thermosensitive image transfer recording medium in the same manner as in Example 2-3. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.10 | 0.52 | 0.82 | 1.01 |

As shown in the above, the image density varied in accordance with the variation of the amount of the applied thermal energy. However, the image density gradation was not suitable for use in practice.

COMPARATIVE EXAMPLE 2-3B

Example 2-3 was repeated except that the vinyl chloride vinyl acetate copolymer solution employed in Example 2-3 was eliminated from the formuation of Example 2-3, whereby a comparative thermosensitive image transfer recording medium No. 2-3B having a thermofusible ink layer with a thickness of 5 μm was prepared. Thermal printing was performed using this comparative thermosensitive image transfer recording medium in the same manner as in Example 2-3. The relationship between the applied thermal energies and the obtained image densities was as follows:

| | | | | |
|---|---|---|---|---|
| Thermal Energy (mJ/dot) | 0.4 | 0.6 | 0.8 | 1.0 |
| Image Density | 0.09 | 0.45 | 0.75 | 0.95 |

As shown in the above, the image density varied in accordance with the variation of the amount of the applied thermal energy. However, the image density gradation was not suitable for use in practice.

EXAMPLE 2-4

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Finely-divided copper particles (Image Gradation Control Agent) | 15 |
| Machine oil | 20 |
| Carnuba wax (Carrier Material) | 20 |
| Caster wax (Carrier Material) | 20 |
| Sorbon T-80 (Non-ionic surfactant, sorbitan monooleate, manufactured by Toho Chemical Industry Co., Ltd.) (Dispersing Agent) | 0.4 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 2-4 according to the present invention was prepared.

Thermal printing was performed using this thermosensitive image transfer recording medium in the same manner as mentioned previously, whereby black images were obtained.

The relationship between the applied thermal energies and the obtained image densities was as follows:

| | | | | | | | | | |
|---|---|---|---|---|---|---|---|---|---|
| Thermal Energy (mJ/dot) | 0.4 | 0.6 | 0.8 | 1.0 | 1.2 | 1.4 | 1.6 | 1.8 | 2.0 |
| Image Density | 0.20 | 0.38 | 0.55 | 0.70 | 0.85 | 0.95 | 1.02 | 1.10 | 1.22 |

As shown above, the image density varied in accordance with the variation of the amount of the applied thermal energy, indicating the availability of image density gradation suitable for use in practice.

COMPARATIVE EXAMPLE 2-4A

Example 2-4 was repeated except that the finely-divided copper particles serving as image gradation control agent in Example 3-4 was eliminated from the formulation of Example 2-4, whereby a comparative thermosensitive image transfer recording medium No. 2-4A having a thermofusible ink layer with a thickness of 4 μm was prepared. Thermal printing was performed using this comparative thermosensitive image transfer recording medium in the same manner as in Example 2-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.22 | 0.80 | 1.10 | 1.15 |

As shown in the above, the image density varied in accordance with the variation of the amount of the applied thermal energy. However, the image density gradation was not suitable for use in practice.

COMPARATIVE EXAMPLE 2-4B

Example 2-4 was repeated except that the vinyl chloride - vinyl acetate copolymer solution employed in Example 2-4 was eliminated from the formuation of Example 2-4, whereby a comparative thermosensitive image transfer recording medium No. 2-4B having a thermofusible ink layer with a thickness of 4 μm was prepared. Thermal printing was performed using this comparative thermosensitive image transfer recording medium in the same manner as in Example 2-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.23 | 0.78 | 1.12 | 1.08 |

As shown in the above, the image density varied in accordance with the variation of the amount of the applied thermal energy. However, the image density gradation was not suitable for use in practice.

In the following Examples 3-1 through 3-4, as the image gradation control agents, needle-like pigments were employed.

EXAMPLE 3-1

A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 3-1 according to the present invention was prepared.

Thermal printing was performed using this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.32 | 0.50 | 0.64 | 0.80 | 0.92 | 1.09 | 1.12 | 1.17 |

As shown above, the image density varied in accordance with the variation of the amount of the applied thermal energy, indicating the availability of image density gradation suitable for use in practice.

COMPARATIVE EXAMPLE 3-1A

Example 3-1 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 3-1, whereby a comparative thermosensitive image transfer recoring medium No. 3-1A having a thermofusible ink layer with a thickness of 5 μm was prepared. Thermal printing was performed using this comparative thermosensitive image transfer recording medium in the same manner as in Example 3-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.20 | 0.65 | 1.95 | 1.15 |

As shown in the above, the image density varied in accordance with the variation of the amount of the applied thermal energy. However, the image density gradation was not suitable for use in practice.

COMPARATIVE EXAMPLE 3-1B

Example3-1 was repeated except that the vinyl chloride - vinyl acetate copolymer solution employed in Example 3-1 was eliminated from the formuation of Example 3-1, whereby a comparative thermosensitive image transfer recording medium No. 3-1B having a thermofusible ink layer with a thickness of 5 μm was prepared. Thermal printing was performed using this comparative thermosensitive image transfer recording medium in the same manner as in Example 3-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.15 | 0.75 | 1.00 | 1.05 |

As shown in the above, the image density varied in accordance with the variation of the amount of the applied thermal energy. However, the image density gradation was not suitable for use in practice.

EXAMPLE 3-2

Example 3-1 was repeated except that Sudan Red 460 (coloring agent) employed in Example 3-1 was replaced by Sudan Blue 670 (manufactured by BASF), so that a thermosensitive image transfer recording material No. 3-2 according to the present invention was prepared. Thermal printing was performed using this thermosensitive image transfer recording material in the same manner as in Example 3-1, so that cyan images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 0.98 | 1.04 | 1.10 |

As shown above, the image density varied in accordance with the variation of the amount of the applied thermal energy, indicating the availability of image density gradation suitable for use in practice.

COMPARATIVE EXAMPLE 3-2A

Example 3-2 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 3-2, whereby a comparative thermosensitive image transfer recording medium No. 3-2A having a thermofusible ink layer with a thickness of 5 μm was prepared. Thermal printing was performed using this comparative thermosensitive image transfer recording medium in the same manner as in Example 3-2. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.18 | 0.45 | 0.88 | 1.12 |

As shown in the above, the image density varied in accordance with the variation of the amount of the applied thermal energy. However, the image density gradation was not suitable for use in practice.

COMPARATIVE EXAMPLE 3-2B

Example 3-2 was repeated except that the vinyl chloride-vinyl acetate copolymer solution employed in Example 3-2 was eliminated from the formuation of Example 3-2, whereby a comparative thermosensitive image transfer recording medium No. 3-2B having a thermofusible ink layer with a thickness of 5 μm was prepared. Thermal printing was performed using this comparative thermosensitive image transfer recording medium in the same manner as in Example 3-2. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.20 | 0.50 | 0.89 | 1.09 |

As shown in the above, the image density varied in accordance with the variation of the amount of the applied thermal energy. However, the image density gradation was not suitable for use in practice.

EXAMPLE 3-3

Example 3-1 was repeated except that Sudan Red 460 (coloring agent) employed in Example 3-1 was replaced by Sudan Yellow 150 (manufactured by BASF), so that a thermosensitive image transfer recording material No. 3-3 according to the present invention was prepared. Thermal printing was performed using this thermosensitive image transfer recording material in the same manner as in Example 3-1, so that yellow images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.19 | 0.35 | 0.50 | 0.70 | 0.78 | 0.85 | 0.92 | 1.00 |

As shown above, the image density varied in accordance with the variation of the amount of the applied thermal energy, indicating the availability of image density modulations suitable for practical use.

COMPARATIVE EXAMPLE 3-3A

Example 3-3 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 3-3, whereby a comparative thermosensitive image transfer recording medium No. 3-3A having a thermofusible ink layer with a thickness of 5 μm was prepared. Thermal printing was performed using this comparative thermosensitive image transfer recording medium in the same manner as in Example 3-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.10 | 0.52 | 0.82 | 1.01 |

As shown in the above, the image density varied in accordance with the variation of the amount of the applied thermal energy. However, the image density gradation was not suitable for use in practice.

COMPARATIVE EXAMPLE 3-3B

Example 3-3 was repeated except that the vinyl chloride-vinyl acetate copolymer solution employed in Example 3-3 was eliminated from the formuation of Example 3-3, whereby a comparative thermosensitive image transfer recording medium No. 3-3B having a thermofusible ink layer with a thickness of 5 μm was prepared. Thermal printing was performed using this comparative thermosensitive image transfer recording medium in the same manner as in Example 3-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.09 | 0.45 | 0.75 | 0.95 |

As shown in the above, the image density varied in accordance with the variation of the amount of the applied thermal energy. However, the image density gradation was not suitable for use in practice.

EXAMPLE 3-4

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Needle-like zinc oxide (Image Gradation Control Agent) | 15 |
| Machine oil | 20 |
| Carnuba wax (Carrier Material) | 20 |
| Caster wax (Carrier Material) | 20 |
| Sorbon T-80 (Non-ionic surfactant, sorbitan monooleate, manufactured by Toho Chemical Industry Co., Ltd.) (Dispersing Agent) | 0.4 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 4-1 according to the present invention was prepared.

Thermal printing was performed using this thermosensitive image transfer recording medium in the same manner as mentioned previously, whereby black images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.20 | 0.38 | 0.55 | 0.70 | 0.85 | 0.95 | 1.02 | 1.10 | 1.22 |

As shown above, the image density varied in accordance with the variation of the amount of the applied thermal energy, indicating the availability of image density gradation suitable for use in practice.

COMPARATIVE EXAMPLE 3-4A

Example 3-4 was repeated except that the needle-like zinc oxide serving as image gradation control agent in Example 3-4 was eliminated from the formulation of Example 4-1, whereby a comparative thermosensitive image transfer recording medium No. 3-4A having a thermofusible ink layer with a thickness of 4 μm was prepared. Thermal printing was performed using this comparative thermosensitive image transfer recording medium in the same manner as in Example 3-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.22 | 0.80 | 1.10 | 1.15 |

As shown in the above, the image density varied in accordance with the variation of the amount of the applied thermal energy. However, the image density gradation was not suitable for use in practice.

COMPARATIVE EXAMPLE 3-4B

Example 3-4 was repeated except that the vinyl chloride-vinyl acetate copolymer solution employed in Example 3-4 was eliminated from the formuation of Example 3-4, whereby a comparative thermosensitive image transfer recording medium No. 3-4B having a thermofusible ink layer with a thickness of 4 μm was prepared. Thermal printing was performed using this comparative thermosensitive image transfer recording medium in the same manner as in Example 3-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.23 | 0.78 | 1.12 | 1.08 |

As shown in the above, the image density varied in accordance with the variation of the amount of the applied thermal energy. However, the image density gradation was not suitable for use in practice.

In the following Examples 4-1 through 4-5, as a carrier material, polycaprolactane was employed.

EXAMPLE 4-1

A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 15 |
| Polycaprolactone (average M.W. 2,000) | 30 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 4-1 according to the present invention was prepared.

Thermal printing was performed on this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.32 | 0.50 | 0.64 | 0.80 | 0.92 | 1.09 | 1.12 | 1.17 |

As shown above, the image density varied in accordance with the variation of the amount of the applied thermal energy, indicating the availability of image density gradation suitable for use in practice.

EXAMPLE 4-2

Example 4-1 was repeated except that Sudan Red 460 (coloring agent) employed in Example 4-1 was replaced by Sudan Blue 670 (manufactured by BASF), so that a thermosensitive image transfer recording material No. 4-2 according to the present invention was prepared. Thermal printing was performed using this thermosensitive image transfer recording material in the same manner as in Example 4-1, so that cyan images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 0.98 | 1.04 | 1.10 |

EXAMPLE 4-3

Example 4-1 was repeated except that Sudan Red 460 (coloring agent) and the polycaprolactone employed in Example 4-1 were respectively replaced by Sudan Yellow 150 (manufactured by BASF) and polycarprolactone (average M.W. 6000), so that a thermosensitive image transfer recording material No. 4-3 according to the present invention was prepared. Thermal printing was performed using this thermosensitive image transfer recording material in the same manner as in Example 4-1, so that yellow images were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.19 | 0.32 | 0.45 | 0.62 | 0.72 | 0.80 | 0.85 | 0.95 |

EXAMPLE 4-4

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Carbon black (Image Gradation Control Agent) | 15 |
| Machine oil (Carrier Material) | 20 |
| Polycaprolactone (average M.W. 10,000) (Carrier Material) | 30 |
| Sorbon T-80 (Non-ionic surfactant, sorbitan monooleate, manufactured by | 0.4 |

-continued

| | Part by Weight |
|---|---|
| Toho Chemical Industry Co., Ltd.) (Dispersing Agent) | |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 4-4 according to the present invention was prepared.

Thermal printing was performed using this thermosensitive image transfer recording medium in the same manner as mentioned previously, whereby clear black images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.10 | 0.30 | 0.45 | 0.59 | 0.78 | 0.83 | 0.90 | 0.99 | 1.05 |

As shown above, the image density varied in accordance with the variation of the amount of the applied thermal energy, indicating the availability of image density gradation suitable for use in practice.

EXAMPLE 4-5

Example 4-1 was repeated except that Sudan Red 460 (coloring agent) employed in Example 4-1 was replaced by Hospaperm Pink E trans (manufactured by Hoechst), so that a thermosensitive image transfer recording material No. 4-5 according to the present invention was prepared. Thermal printing was performed using this thermosensitive image transfer recording material in the same manner as in Example 4-1, so that high quality images with the following excellent image gradation were obtained. The relationship between the applied thermal energies and the obtained image densities was as follows:

| Thermal Energy (mJ/dot) | 0.4 | 0.8 | 1.2 | 1.6 | 2.0 | 2.4 | 2.8 |
|---|---|---|---|---|---|---|---|
| Image Density | 0.09 | 0.30 | 0.50 | 0.65 | 0.85 | 0.96 | 1.10 |

In the following Examples 5-1 and 5-2, lanolin fatty acid derivatives are employed as an auxiliary oil component for forming the porous resin structure.

EXAMPLE 5-1

A mixture of the following components was dispersed in a ball mill at 68° C. for about 48 hours:

| | Part by Weight |
|---|---|
| Sudan Red 460 (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Barium salt of lanolin fatty acid (Carrier Material) | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 5-1 according to the present invention was prepared.

Thermal printing was performed on this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.32 | 0.50 | 0.64 | 0.80 | 0.92 | 1.09 | 1.12 | 1.17 |

As shown above, the image density varied in accordance with the variation of the amount of the applied thermal energy, indicating the availability of image density gradation suitable for use in practice.

EXAMPLE 5-2

Example 5-1 was repeated except that Sudan Red 670 (coloring agent) and barium salt of lanolin fatty acid employed in Example 5-1 were respectively replaced by Sudan Blue 670 (manufactured by BASF) and potassium salt of lanolin fatty acid, so that a thermosensitive image transfer recording material No. 5-2 according to the present invention was prepared. Thermal printing was performed using this thermosensitive image transfer recording material in the same manner as in Example 5-1, so that cyan images were obtined. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 0.98 | 1.04 | 1.10 |

COMPARATIVE EXAMPLE 5-1A

Example 5-1 was repeated except that barium salt of lanolin fatty acid employed in Example 5-1 was eliminated from the formulation of Example 5-1, whereby a comparative thermosensitive image transfer recording medium No. 5-1A having a thermofusible ink layer with a thickness of 5 μm was obtained. Thermal printing was performed using this thermosensitive image transfer recording material in the same manner as in Example 5-1. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.10 | 0.12 | 0.14 | 0.17 | 0.18 | 0.17 | 0.16 | 0.17 |

As shown in the above, the image gradation was not suitable for use in practice. thermal energy. However, the image density gradation was not suitable for use in practice.

In the following Examples 6-1 through 6-4, finely-divided pigment particles and needle-like pigments are contained in the porous resin structure.

EXAMPLE 6-1

A mixture of the following components was dispersed in a ball mill at 68° C. for about 48 hours:

| | Part by Weight |
|---|---|
| Hostapern Pink E trans (Coloring Agent) (manufactured by Hoechst) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 6-1 according to the present invention was prepared.

Thermal printing was performed on this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.30 | 0.50 | 0.66 | 0.81 | 0.92 | 1.05 | 1.12 | 1.18 |

As shown above, the image density varied in accordance with the variation of the amount of the applied thermal energy, indicating the availability of image density modulations suitable for practical use.

COMPARATIVE EXAMPLE 6-1A

Example 6-1 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 6-1, whereby a comparative thermosensitive image transfer recording medium No. 6-1 having a thermofusible ink layer with a thickness of 5 μm was prepared. Thermal printing was performed using this comparative thermosensitive image transfer recording medium in the same manner as in Example 6-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.25 | 0.75 | 1.01 | 1.25 |

As shown in the above, the image density varied in accordance with the variation of the amount of the applied thermal energy. However, the image density gradation was not suitable for use in practice.

COMPARATIVE EXAMPLE 6-1B

Example 6-1 was repeated except that the vinyl chloride-vinyl acetate copolymer solution employed in Example 6-1 was eliminated from the formulation of Example 6-1, whereby a comparative thermosensitive image transfer recording medium No. 6-1B having a thermofusible ink layer with a thickness of 5 μm was prepared. Thermal printing was performed using this comparative thermosensitive image transfer recording medium in the same manner as in Example 6-1. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.60 | 1.05 | 1.10 | 1.28 |

As shown in the above, the image density varied in accordance with the variation of the amount of the applied thermal energy. However, the image density gradation was not suitable for use in practice.

EXAMPLE 6-2

Example 6-1 was repeated except that Hostapern Pink E trans (coloring agent) employed in Example 6-1 was replaced by Reflex Blue R 50 (manufactured by Hoechst), so that a thermosensitive image transfer recording material No. 6-2 according to the present invention was prepared. Thermal printing was performed using this thermosensitive image transfer recording material in the same manner as in Example 6-1, so that cyan images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.20 | 0.39 | 0.55 | 0.75 | 0.82 | 0.97 | 1.05 | 1.10 |

As shown above, the image density varied in accordance with the variation of the amount of the applied thermal energy, indicating the availability of image density modulations suitable for practical use.

COMPARATIVE EXAMPLE 6-2A

Example 6-2 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 6-2, whereby a comparative thermosensitive image transfer recording medium No. 6-2A having a thermofusible ink layer with a thickness of 5 μm was prepared. Thermal printing was performed using this comparative thermosensitive image transfer recording medium in the same manner as in Example 6-2. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.18 | 0.45 | 0.90 | 1.18 |

As shown in the above, the image density varied in accordance with the variation of the amount of the applied thermal energy. However, the image density gradation was not suitable for use in practice.

COMPARATIVE EXAMPLE 6-2B

Example 6-2 was repeated except that the vinyl chloride-vinyl acetate copolymer solution employed in Example 6-2 was eliminated from the formulation of Example 6-2, whereby a comparative thermosensitive image transfer recording medium No. 6-2B having a thermofusible ink layer with a thickness of 5 μm was prepared. Thermal printing was performed using this comparative thermosensitive image transfer recording medium in the same manner as in Example 6-2. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.20 | 0.75 | 0.89 | 1.09 |

As shown in the above, the image density varied in accordance with the variation of the amount of the applied thermal energy. However, the image density gradation was not suitable for use in practice.

EXAMPLE 6-3

Example 6-1 was repeated except that Hostapern Pink E trans (coloring agent) employed in Example 6-1 was replaced by Permanent Yellow G02 (manufactured by Hoechst), so that a thermosensitive image transfer recording material No. 6-3 according to the present invention was prepared. Thermal printing was performed using this thermosensitive image transfer recording material in the same manner as in Example 6-1, so that yellow images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.20 | 0.34 | 0.51 | 0.72 | 0.79 | 0.86 | 0.93 | 1.02 |

As shown above, the image density varied in accordance with the variation of the amount of the applied thermal energy, indicating the availability of image density modulations suitable for practical use.

COMPARATIVE EXAMPLE 6-3A

Example 6-3 was repeated except that 2,7-bis[2-hydroxy-3-(2-chlorophenylcarbamoyl)naphthalene-1-ylazo]-9-fluorenone serving as needle-like image gradation control agent was eliminated from the formulation of Example 6-3, whereby a comparative thermosensitive image transfer recording medium No. 6-3A having a thermofusible ink layer with a thickness of 5 μm was prepared. Thermal printing was performed using this comparative thermosensitive image transfer recording medium in the same manner as in Example 6-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.10 | 0.52 | 0.82 | 1.01 |

As shown in the above, the image density varied in accordance with the variation of the amount of the applied thermal energy. However, the image density gradation was not suitable for use in practice.

COMPARATIVE EXAMPLE 6-3B

Example 6-3 was repeated except that the vinyl chloride-vinyl acetate copolymer solution employed in Example 6-3 was eliminated from the formulation of Example 6-3, whereby a comparative thermosensitive image transfer recording medium No. 6-3B having a thermofusible ink layer with a thickness of 5 μm was prepared. Thermal printing was performed using this comparative thermosensitive image transfer recording medium in the same manner as in Example 6-3. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.09 | 0.55 | 0.75 | 0.95 |

As shown in the above, the image density varied in accordance with the variation of the amount of the applied thermal energy. However, the image density gradation was not suitable for use in practice.

EXAMPLE 6-4

A mixture of the following components was dispersed in a ball mill at 68° C. for about 48 hours:

| | Part by Weight |
|---|---|
| Permanent Lake Red LC 402 (manufactured by Hoechst) (Coloring Agent) | 8 |
| Needle-like zinc oxide (Image Gradation Control Agent) | 15 |
| Machine oil | 20 |
| Carnuba wax (Carrier Material) | 20 |
| Caster wax (Carrier Material) | 20 |
| Sorbon T-80 (Non-ionic surfactant, sorbitan monooleate, manufactured by Toho Chemical Industry Co., Ltd.) (Dispersing Agent) | 0.4 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 6-4 according to the present invention was prepared.

Thermal printing was performed on this thermosensitive image transfer recording medium in the same manner as mentioned previously, whereby red images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.19 | 0.37 | 0.54 | 0.71 | 0.84 | 0.93 | 1.00 | 1.08 | 1.20 |

As shown above, the image density varied in accordance with the variation of the amount of the applied thermal energy, indicating the availability of image density modulations suitable for practical use.

COMPARATIVE EXAMPLE 6-4A

Example 6-4 was repeated except that the needle-like zinc oxide serving as image gradation control agent in Example 6-4 was eliminated from the formulation of Example 6-4, whereby a comparative thermosensitive image transfer recording medium No. 6-4A having a thermofusible ink layer with a thickness of 4 μm was prepared. Thermal printing was performed using this comparative thermosensitive image transfer recording medium in the same manner as in Example 6-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.22 | 0.80 | 1.10 | 1.15 |

As shown in the above, the image density varied in accordance with the variation of the amount of the applied thermal energy. However, the image density gradation was not suitable for use in practice.

COMPARATIVE EXAMPLE 6-4B

Example 6-4 was repeated except that the vinyl chloride-vinyl acetate copolymer solution employed in Example 6-4 was eliminated from the formulation of Example 6-4, whereby a comparative thermosensitive image transfer recording medium No. 6-4B having a thermofusible ink layer with a thickness of 4 μm was prepared. Thermal printing was performed using this comparative thermosensitive image transfer recording medium in the same manner as in Example 6-4. The relationship between the applied thermal energies and the obtained image densities was as follows:

| Thermal Energy (mJ/dot) | 0.4 | 0.6 | 0.8 | 1.0 |
|---|---|---|---|---|
| Image Density | 0.23 | 0.80 | 1.12 | 1.18 |

As shown in the above, the image density varied in accordance with the variation of the amount of the applied thermal energy. However, the image density gradiation was not suitable for use in practice.

In the following Exmaples 7-1 through 7-4, as the image gradiation control agent, perylene derivatives were employed.

EXAMPLE 7-1

A mixture of the following components was dispersed in a ball mill at 68° C. for about 48 hours;

| | Part by Weight |
|---|---|
| Sudan Red 460 (manufactured by BASF) (Coloring Agent) | 10 |
| Paliogen Red 3910 (manufactured by BASF) (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 7-1 according to the present invention was prepared.

Thermal printing was performed using this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.30 | 0.50 | 0.62 | 0.80 | 0.90 | 1.09 | 1.10 | 1.14 |

As shown above, the image density varied in accordance with the variation of the amount of the applied thermal energy, indicating the availability of image density gradation suitable for use in practice.

EXAMPLE 7-2

Example 7-1 was repeated except that Sudan Red 460 (coloring agent) and Paliogen Red 3910 (image gradation control agent) employed in Example 7-1 were respectively replaced by Sudan Blue 670 (manufactured by BASF) and Paliogen Red KL 3870HD, so that a thermosensitive image transfer recording material No. 7-2 according to the present invention was prepared. Thermal printing was performed using this thermosensitive image transfer recording material in the same manner as in Example 7-1, so that cyan images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.07 | 0.21 | 0.35 | 0.55 | 0.72 | 0.81 | 0.94 | 1.04 | 1.09 |

As shown above, the image density varied in accordance with the variation of the amount of the applied thermal energy, indicating the availability of image density modulations suitable for practical use.

EXAMPLE 7-3

Example 7-1 was repeated except that Sudan Red 460 (coloring agent) and Paliogen Red 3910 (image gradation control agent) employed in Example 7-1 were respectively replaced by Sudan Yellow 150 (manufactured by BASF) and Sumitomo Fast Maroon B (manufactured by Sumitomo Chemical Co., Ltd.), so that a thermo-sensitive image transfer recording material No. 7-3 according to the present invention was prepared. Thermal printing was performed using this thermosensitive image transfer recording material in the same manner as in Example 7-1, so that clear yellow images with the following excellent image gradation were obtained, without the image gradation control agent being transferred to the receiving sheet at all. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.15 | 0.34 | 0.42 | 0.65 | 0.72 | 0.78 | 0.82 | 0.92 |

As shown above, the image density varied in accordance with the variation of the amount of the applied thermal energy, indicating the availability of image density gradation suitable for use in practice.

EXAMPLE 7-4

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Paliogen Maroon G (manufactured by BASF) (Image Gradation Control Agent) | 15 |
| Machine oil | 20 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 82 m, by a wire bar, and was then dried at 100° C. for 1 minute, so that a thermofusible ink layer having a thickness of about 4 μm was formed on the polyester film, whereby a thermosensitive image transfer recording medium No. 7-4 according to the present invention was prepared.

Thermal printing was performed using this thermosensitive image transfer recording medium in the same manner as in Example 7-1, so that clear black images with the following excellent image gradation were obtained, without the image gradation control agent being transferred to the receiving sheet at all.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.20 | 0.34 | 0.55 | 0.66 | 0.85 | 0.91 | 1.02 | 1.07 | 1.20 |

As shown above, the image density varied in accordance with the variation of the amount of the applied thermal energy, indicating the availability of image density gradation suitable for use in practice.

COMPARATIVE EXAMPLE 7-1A

Example 7-1 was repeated except that the image gradation control agent was replaced by a quinacridone pigment, Hosaperm Pink E trans (manufactured by Hoechst), whereby a comparative thermosensitive image transfer recording medium No. 7-1A was prepared. Thermal printing was performed using this comparative thermosensitive image transfer recording medium in the same manner as in Example 7-1. As a result, magenta images were not obtained, but light pink images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.15 | 0.54 | 0.88 | 1.00 | 1.00 | 1.02 | 0.99 | 1.00 | 1.01 |

COMPARATIVE EXAMPLE 7-1B

Example 7-1 was repeated except that the image gradation control agent was replaced by a triphenylmethane pigment, Reflex Blue 150 (manufactured by Hoechst), whereby a comparative thermosensitive image transfer recording medium No. 7-1B was prepared. Thermal printing was performed using this comparative thermosensitive image transfer recording medium in the same manner as in Example 7-1. As a result, dark purple images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.10 | 0.48 | 0.82 | 1.05 | 1.10 | 1.11 | 1.12 | 1.12 | 1.11 |

COMPARATIVE EXAMPLE 7-1C

Example 7-1 was repeated except that the image gradation control agent was replaced by a diazonium pigment, Permanent Yellow GG02 (manufactured by Hoechst), whereby a comparative thermosensitive image transfer recording medium No. 7-1C was prepared. Thermal printing was performed using this comparative thermosensitive image transfer recording medium in the same manner as in Example 7-1. As a result, dull orange images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.49 | 0.88 | 0.92 | 1.02 | 1.05 | 1.06 | 1.08 | 1.07 |

COMPARATIVE EXAMPLE 7-1D

Example 7-1 was repeated except that the image gradation control agent was replaced by a carbon black, Printex 90 (manufactured by Degussa), whereby a comparative thermosensitive image transfer recording medium No. 7-1D was prepared. Thermal printing was performed using this comparative thermosensitive image transfer recording medium in the same manner as in Example 7-1. As a result, dull black images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.10 | 0.62 | 0.92 | 1.10 | 1.11 | 1.15 | 1.20 | 1.21 | 1.20 |

COMPARATIVE EXAMPLE 7-1E

Example 7-1 was repeated except that the image gradation control agent was replaced by carbon black, Raven 410 (manufactured by Columbia), whereby a comparative thermosensitive image transfer recording medium No. 7-1E was prepared. Thermal printing was performed using this comparative thermosensitive image transfer recording medium in the same manner as in Example 7-1. As a result, dull black images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.49 | 0.88 | 1.00 | 1.05 | 1.10 | 1.20 | 1.19 | 1.20 |

COMPARATIVE EXAMPLE 7-1F

Example 7-1 was repeated except that the image gradation control agent was replaced by graphite, UFG-5 (manufactured by Showa Denko K.K.), whereby a comparative thermosensitive image transfer recording medium No. 7-1F was prepared. Thermal printing was performed using this comparative thermosensitive image transfer recording medium in the same manner as in Example 7-1. As a result, dull black images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.50 | 0.85 | 1.03 | 1.10 | 1.20 | 1.19 | 1.18 | 1.19 |

COMPARATIVE EXAMPLE 7-1G

Example 7-1 was repeated except that the image gradation control agent was replaced by zinc oxide, Sazex 4000 (manufactured by Sakai Kagaku Kogyo K.K.), whereby a comparative thermosensitive image transfer recording medium No. 7-1G was prepared. Thermal printing was performed using this comparative thermosensitive image transfer recording medium in the same manner as in Example 7-1. As a result, light pink images were obtained. The relationship between the applied thermal energies and the obtained densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.20 | 0.41 | 0.52 | 0.07 | 0.78 | 0.80 | 0.81 | 0.82 |

In Comparative Examples 7-1A through 7-1G, the image gradations were all dull and the employed image gradation control agents were transferred to the receiving sheet as the amount of the applied thermal energy was increased. As a result, the desired clear magneta color was not obtained.

In the following Examples 8-1 through 8-4, as the image gradation control agents, phthalocyanine derivatives were employed.

EXAMPLE 8-1

A mixture of the following components was dispersed in a ball mill at 68° C. for about 48 hours:

| | Part by Weight |
|---|---|
| Sudan Red 460 (Coloring Agent) (manufactured by BASF) | 10 |
| Heliogen Blue D 7030 (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Tono Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 8-1 according to the present invention was prepared.

Thermal printing was performed using this thermosensitive image transfer recording medium in the same manner as mentioned previously, whereby magenta images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.17 | 0.30 | 0.48 | 0.61 | 0.78 | 0.89 | 1.41 | 1.08 | 1.15 |

As shown above, the image density varied in accordance with the variation of the amount of the applied thermal energy, indicating the availability of image density gradation suitable for use in practice.

EXAMPLE 8-2

Example 8-1 was repeated except that Sudan Red 460 (coloring agent) and Heliogen Blue D 7030 (image gradation control agent) employed in Example 8-1 were respectively replaced by Sudan Blue 670 (manufactured by BASF) and Fastogen Blue TGR, so that a thermosensitive image transfer recording material No. 8-2 according to the present invention was prepared. Thermal printing was performed using this thermosensitive image transfer recording material in the same manner as in Example 8-1, so that cyan images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.19 | 0.35 | 0.52 | 0.73 | 0.37 | 0.94 | 1.00 | 1.09 |

As shown above, the image density varied in accordance with the variation of the amount of the applied thermal energy, indicating the availability of image density gradation suitable for use in practice.

EXAMPLE 8-3

Example 8-1 was repeated except that Sudan Red 460 (coloring agent) and Heliogen Blue D 7030 (image gradation control agent) employed in Example 8-1 were respectively replaced by Sudan Yellow 150 (manufactured by BASF) and Heliogen Green GG (manufactured by BASF), so that a thermosensitive image transfer recording material No. 8-3 according to the present invention was prepared. Thermal printing was performed using this thermosensitive image transfer recording material in the same manner as in Example 8-1, so that clear yellow images with the following excellent image gradation were obtained, without the image gradation control agent being transferred to the receiving sheet at all. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.07 | 0.15 | 0.30 | 0.45 | 0.64 | 0.73 | 0.80 | 0.88 | 0.95 |

As shown above, the image density varied in accordance with the variation of the amount of the applied thermal energy, indicating the availability of image density gradation suitable for use in practice.

EXAMPLE 8-4

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| Heliogen Blue SBL (manufactured by BASF) (Image Gradation Control Agent) | 15 |
| Machine oil | 20 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 8-4 according to the present invention was prepared.

Thermal printing was performed using this thermosensitive image transfer recording medium in the same manner as in Example 8-1, so that clear black images with the following excellent image gradation were obtained, without the image gradation control agent being transferred to the receiving sheet at all.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.18 | 0.36 | 0.53 | 0.68 | 0.83 | 0.93 | 1.00 | 1.08 | 1.20 |

As shown above, the image density varied in accordance with the variation of the amount of the applied thermal energy, indicating the availability of image density modulations suitable for practical use.

In the following Examples 9-1 through 9-6, as the image gradiation control agents, azo compounds were employed.

EXAMPLE 9-1

A mixture of the following components was dispersed in a ball mill at 68° C. for about 48 hours:

| | Part by Weight |
|---|---|
| Sudan Blue 670 (Coloring Agent) (manufactured by BASF) | 10 |
| Vulcan Fast Yellow G (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 9-3 according to the present invention was prepared.

Thermal printing was performed using this thermosensitive image transfer recording medium in the same manner as mentioned previously, whereby cyan images were obtained.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.09 | 0.21 | 0.38 | 0.55 | 0.75 | 0.81 | 1.98 | 1.04 | 1.10 |

As shown above, the image density varied in accordance with the variation of the amount of the applied thermal energy, indicating the availability of image density gradation suitable for use in practice.

EXAMPLE 9-2

Example 9-1 was repeated except that Sudan Blue 670 (coloring agent) and Vulcan Fast Yellow G (image gradation control agent) employed in Example 9-1 were respectively replaced by Sudan Yellow 150 (manufactured by BASF) and Permanent Carmine FBB02 (manufactured by Hoechst), so that a thermosensitive image transfer recording material No. 9-2 according to the present invention was prepared. Thermal printing was performed using this thermosensitive image transfer recording material in the same manner as in Example 9-1, so that yellow images with the following excellent image gradation were obtained. The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.08 | 0.19 | 0.35 | 0.50 | 0.70 | 0.78 | 0.85 | 0.92 | 1.00 |

As shown above, the image density varied in accordance with the variation of the amount of the applied thermal energy, indicating the availability of image density gradation suitable for use in practice.

EXAMPLE 9-3

A mixture of the following components was dispersed in a ball mill at 68° C. for about 48 hours:

| | Part by Weight |
|---|---|
| Kayaset Black G (manufactured by Nippon Kayaku Co., Ltd.) (Coloring Agent) | 8 |
| 4,4''-bis[2-hydroxy-3-(2,4-dimethylphenyl) carbamoylnaphthalene-1-ylazo]-1,4-di-styrylbenzne (Image Gradation Control Agent) | 15 |
| Machine oil | 20 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 9-3 according to the present invention was prepared.

Thermal printing was performed using this thermosensitive image transfer recording medium in the same manner as in Example 9-1, so that clear black images with the following excellent image gradation were obtained, without the image gradation control agent being transferred to the receiving sheet at all.

The relationship between the applied thermal energies and the obtained image densities was as follows:

| Thermal Energy (mJ/dot) | 0.4 | 0.6 | 0.8 | 1.0 | 1.2 | 1.4 | 1.6 | 1.8 | 2.0 |
|---|---|---|---|---|---|---|---|---|---|
| Image Density | 0.20 | 0.38 | 0.55 | 0.70 | 0.85 | 0.95 | 1.02 | 1.10 | 1.22 |

As shown above, the image density varied in accordance with the variation of the amount of the applied thermal energy, indicating the availability of image density modulations suitable for practical use.

EXAMPLE 9-4

Example 9-1 was repeated except that Vulcan Fast Yellow G (image gradation control agent) employed in Example 9-1 was replaced by Hansa Yellow 5G, so that a thermosensitive image transfer recording material No. 9-4 according to the present invention was prepared. Thermal printing was performed using this thermosensitive image transfer recording material in the same manner as in Example 9-1. As a result, magenta images with excellent image gradation were obtained, without the image gradation control agent being transferred to the receiving sheet.

EXAMPLE 9-5

Example 9-1 was repeated except that Vulcan Fast Yellow G (image gradation control agent) employed in Example 9-1 was replaced by Permanent Red FR extra, so that a thermosensitive image transfer recording material No. 9-5 according to the present invention was prepared. Thermal printing was performed using this thermosensitive image transfer recording material in the same manner as in Example 9-1. As a result, magenta images with excellent image gradation were obtained, without the image gradation control agent being transferred to the receiving sheet.

EXAMPLE 9-6

Example 9-1 was repeated except that Vulcan Fast Yellow G (image gradation control agent) employed in Example 9-1 was replaced by Vulcan Fast Blue 3G, so that a thermosensitive image transfer recording material No. 9-6 according to the present invention was prepared. Thermal printing was performed using this thermosensitive image transfer recording material in the same manner as in Example 9-1. As a result, magenta images with excellent image gradation were obtained, without the image gradation control agent being transferred to the receiving sheet.

In the following Examples 10-1 through 10-4, as the coloring agents, oil-soluble phthalocyanine dyes were employed.

EXAMPLE 10-1

A mixture of the following components was dispersed in a ball mill at 68° C. for about 48 hours:

| | Part by Weight |
|---|---|
| Neozapon Blue 807 (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 10-1 according to the present invention was prepared.

Thermal printing was performed on this thermosensitive image transfer recording medium in the same manner as mentioned previously, whereby cyan images were obtained.

Figure 6:
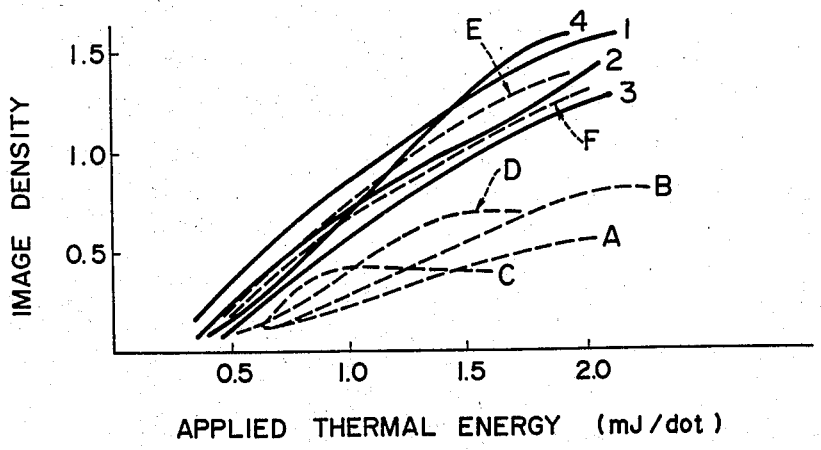
FIG. 6 is a graph showing the relationship between the image gradation and thermal energy applied per dot in examples of a thermosensitive image transfer recording materials according to the present invention and in comparative examples of a thermosensitive image transfer recording material.

The relationship between the applied thermal energies and the obtained image densities is shown by the solid curve (image gradation characteristics curve) 1 in FIG. 6. This curve indicates that the image density varied smoothly in accordance with the variation of the amount of the applied thermal energy, so that image gradation suitable for use in practice was available.

EXAMPLE 10-2

Example 10-1 was repeated except that Neozapon Blue 807 (coloring agent) employed in Example 10-1 was replaced by Neozapon Blue 806 (manufactured by BASF), so that a thermosensitive image transfer recording material No. 10-2 according to the present invention was prepared. Thermal printing was performed using this thermosensitive image transfer recording material in the same manner as in Example 10-1. As a result, cyan images with excellent image gradation were obtained as indicated by the image gradation characteristics curve 2 in FIG. 6.

EXAMPLE 10-3

Example 10-1 was repeated except that Neozapon Blue 807 (coloring agent) employed in Example 10-1 was replaced by Neptune Blue 722 (manufactured by BASF), so that a thermosensitive image transfer recording material No. 10-3 according to the present invention was prepared. Thermal printing was performed using this thermosensitive image transfer recording material in the same manner as in Example 10-3. As a result, cyan images with excellent image gradiation were obtained, as indicated by the image gradation characteristics curve 3 in FIG. 6.

EXAMPLE 10-4

A mixture of the following components was dispersed in a ball mill at 68° C. for about 48 hours:

| | Part by Weight |
|---|---|
| Neozapon Blue 807 (Coloring Agent) (manufactured by BASF) | 8 |
| Beliogen Blue D 7030 (Image Gradation Control Agent) | 15 |
| Machine oil | 20 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.4 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 10-1 according to the present invention was prepared.

Thermal printing was performed using this thermosensitive image transfer recording medium in the same manner as mentioned previously, whereby cyan images were obtained.

The relationship between the applied thermal energies and the obtained image densities is shown by the solid curve (image gradation characteristics curve) 4 in FIG. 6. This curve indicates that the image density varied smoothly in accordance with the variation of the amount of the applied thermal energy, so that image gradation suitable for use in practice was available.

COMPARATIVE EXAMPLE 10-1A

Example 10-1 was repeated except that Neozapon Blue 807 (coloring agent) employed in Example 10-1 was replaced by a cationic dye, Remacry Green (manufactured by Hoechst), having the following formula, so that a comparative thermosensitive image transfer recording material No. 10-1A was prepared. Thermal printing was performed using this thermosensitive image transfer recording material in the same manner as in Example 10-1. As a result, green images with the image gradation as indicated by the image gradation characteristics broken curve A in FIG. 6 were obtained.

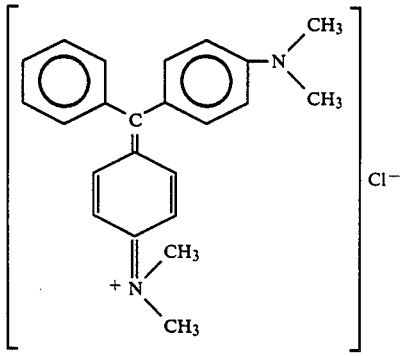

COMPARATIVE EXAMPLE 10-1B

Example 10-1 was repeated except that Neozapon Blue 807 (coloring agent) employed in Example 10-1 was replaced by a disazo dye, Duasyn Direct Red 8 B 01 (manufactured by Hoechst), having the following formula, so that a comparative thermosensitive image transfer recording material No. 10-1B was prepared. Thermal printing was performed using this thermosensitive image transfer recording material in the same manner as in Example 10-1. As a result, images with the image gradation as indicated by the image gradation characteristics broken curve B in FIG. 6 were obtained.

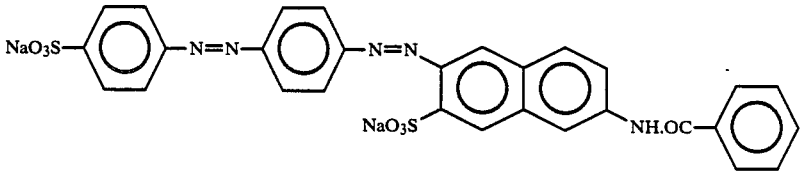

COMPARATIVE EXAMPLE 10-1C

Example 10-1 was repeated except that Neozapon Blue 807 (coloring agent) employed in Example 10-1 was replaced by a reactive dye, Remazole Red 3B (manufactured by Hoechst), so that a comparative thermosensitive image transfer recording material No. 10-1C was prepared. Thermal printing was performed using this thermosensitive image transfer recording material in the same manner as in Example 10-1. As a result, images with the image gradation as indicated by the image gradation characteristics broken curve C in FIG. 6 were obtained.

COMPARATIVE EXAMPLE 10-1D

Example 10-1 was repeated except that Neozapon Blue 807 (coloring agent) employed in Example 10-1 was replaced by an azoic dye, Naphthol AS (manufactured by Hoechst), having the following formula, so that a comparative thermosensitive image transfer recording material No. 10-1D was prepared. Thermal printing was performed using this thermosensitive image transfer recording material in the same manner as in Example 10-1.

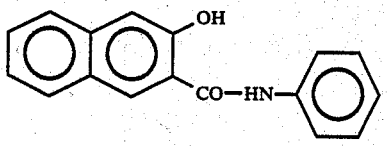

As a result, images with the image gradation as indicated by the image gradation characteristics broken curve D in FIG. 6 were obtained.

COMPARATIVE EXAMPLE 10-1E

Example 10-1 was repeated except that Neozapon Blue 807 (coloring agent) employed in Example 10-1 was replaced by an oil dye, Sudan Red 460 (manufactured by BASF), having the following formula, so that a comparative thermosensitive image transfer recording material No. 10-1E was prepared. Thermal printing was performed using this thermosensitive image transfer recording material in the same manner as in Example 10-1.

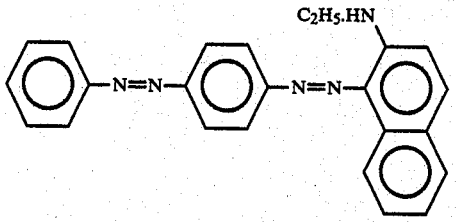

As a result, images with the image gradation as indicated by the image gradation characteristics broken curve E in FIG. 6 were obtained.

COMPARATIVE EXAMPLE 10-1F

Example 10-1 was repeated except that Neozapon Blue 807 (coloring agent) employed in Example 10-1 was replaced by an oil dye, Sudan Black X60 (manufactured by BASF), having the following formula, so that a comparative thermosensitive image transfer recording material No. 10-1F was prepared. Thermal printing was performed using this thermosensitive image transfer recording material in the same manner as in Example 10-1.

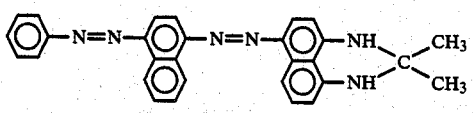

As a result, images wihh the image gradation as indicated by the image gradation characteristics broken curve F in FIG. 6 were obtained.

The recorded-image-bearing receiving sheets prepared by use of the above thermosensitive image transfer recording materials Nos. 10-1, 10-2, 10-3 and 10-4 according to the present invention and the comparative image transfer recording materials Nos. 10-1A, 10-1B, 10-1B, 10-1C, 10-1D, 10-1E and 10-1F were exposed to the light emitted from a fade meter for 24 hours, so that the the decrease in the image density of each receiving sheet was measured to see the light resistance of each recorded image. The above recorded-image-bearing receiving sheets were also placed in a constant-temperature chamber at 60° C. for one week to see the durability thereof.

The results were as in the following Table:

TABLE 3

| Recording Material | Light Resistance (Exposure for 10 hrs.) | Durability (50° C. for 1 week) |
|---|---|---|
| No. 10-1 | o | o |
| No. 10-2 | o | o |
| No. 10-3 | o | o |
| No. 10-4 | o | o |
| Comp. No. 10-1A | Δ | o |
| Comp. No. 10-1B | Δ | o |
| Comp. No. 10-1C | o | o |
| Comp. No. 10-1D | Δ | Δ |
| Comp. No. 10-1E | x | x |
| Comp. No. 10-1F | Δ | x |

Note: o indicates that the decrease in image density was 10% or less; Δ indicates that the decrease in image density was 10 to 50%; and x indicates that the decrease in image density was 50% or more.

In the following Examples 11-1 through 11-4, as the coloring agents, monoazo pigments were employed.

EXAMPLE 11-1

A mixture of the following components was dispersed in a ball mill at 68° C. for about 48 hours:

| | Part by Weight |
|---|---|
| Neozapon Red GE (Coloring Agent) (manufactured by BASF) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 11-1 according to the present invention was prepared.

Thermal printing was performed using this thermosensitive image transfer recording medium in the same manner as mentioned previously, whereby cyan images were obtained.

Figure 7:
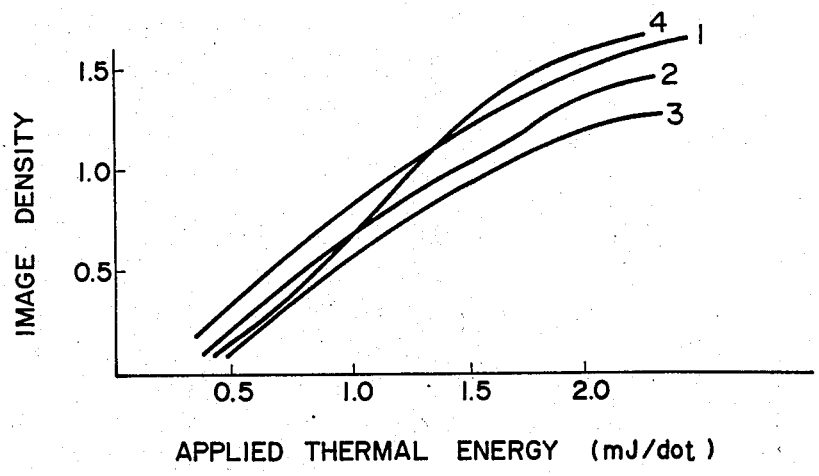
FIG. 7 is a graph showing the relationship between the image density and thermal energy applied per dot in examples of a thermosensitive image transfer recording material according to the present invention and in comparative examples of a thermosensitive image transfer recording material.

The relationship between the applied thermal energies and the obtained image densities is shown by the solid curve (image gradation characteristics curve) 1 in FIG. 7. This curve indicates that the image density varied smoothly in accordance with the variation of the amount of the applied thermal energy, so that image gradation suitable for use in practice was available.

EXAMPLE 11-2

Example 11-1 was repeated except that Neozapon Red GE (coloring agent) employed in Example 11-1 was replaced by Spilon Red GRLT Special (manufactured by Hodogaya Chemical Co., Ltd.), so that a thermosensitive image transfer recording material No. 11-2 according to the present invention was prepared. Thermal printing was performed using this thermosensitive image transfer recording material in the same manner as in Example 11-1. As a result, yellow images with excellent image gradation were obtained as indicated by the image gradation characteristics curve 2 in FIG. 7.

EXAMPLE 11-3

Example 11-1 was repeated except that Neozapon Red GE (coloring agent) employed in Example 11-1 was replaced by Neozapon Yellow R (manufactured by BASF), so that a thermosensitive image transfer recording material No. 11-3 according to the present invention was prepared. Thermal printing was performed using this thermosensitive image transfer recording material in the same manner as in Example 11-1. As a result, yellow images with excellent image gradation were obtained as indicated by the image gradation characteristics curve 3 in FIG. 7.

EXAMPLE 11-4

A mixture of the followng components was dispersed in a ball mill at 68° C. for about 48 hours:

| | Part by Weight |
|---|---|
| Neozepon Black RE (Coloring Agent) (manufactured by BASF) | 8 |
| Heliogen Blue D 7030 (Image Gradation Control Agent) (manufactured by BASF) | 15 |
| Machine oil | 20 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.4 |
| Liquid paraffin | 4 |
| Methyl ethyl ketone | 100 |

-continued

| | Part by Weight |
|---|---|
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 4 μm was formed on the polyester film, whereby a thermosensitive image transfer recording medium No. 11-4 according to the present invention was prepared.

Thermal printing was performed using this thermosensitive image transfer recording medium in the same manner as mentioned previously, whereby black images were obtained.

The relationship between the applied thermal energies and the obtained image densities is shown by the solid curve (image gradation characteristics curve) 4 in FIG. 7. This curve indicates that the image density varied smoothly in accordance with the variation of the amount of the applied thermal energy, so that image gradation suitable for use in practice was available.

Recorded-image-bearing receiving sheets prepared by use of the above thermosensitive image transfer recording materials Nos. 11-1, 11-2, 11-3 and 11-4 according to the present invention were exposed to the light emitted from a fade meter for 24 hours, so that the the decrease in the image density of each receiving sheet was measured to see the light resistance of each recorded image. The above recorded-image-bearing receiving sheets werre also placed in a constant-temperature chamber at 60° C. for one week to see the durability thereof. The result was that in each receiving material, the decrease in image density was less than 10% in both the light resistance test and the durability test.

In the following Examples 12-1 through 12-4, as the coloring agents, monoazo pigments were employed.

EXAMPLE 12-1

A mixture of the following components was dispersed in a ball mill at 68° C. for about 48 hours:

| | Part by Weight |
|---|---|
| First Red 1547 (Coloring Agent) (manufactured by Dainichi Seika Color and Chemicals Mfg. Co., Ltd.) | 10 |
| 2,7-bis[2-hydroxy-3-(2-chlorophenylcarbamoly)-naphthalene-1-ylazo]-9-fluorenone (Image Gradation Control Agent) | 10 |
| Modified lanolin oil | 30 |
| Carnauba wax (Carrier Material) | 20 |
| Paraffin wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 5 |
| Methyl ethyl ketone | 100 |

-continued

| | Part by Weight |
|---|---|
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 12-1 according to the present invention was prepared.

Thermal printing was performed using this thermosensitive image transfer recording medium in the same manner as mentioned previously, whereby magneta images were obtained.

Figure 8:
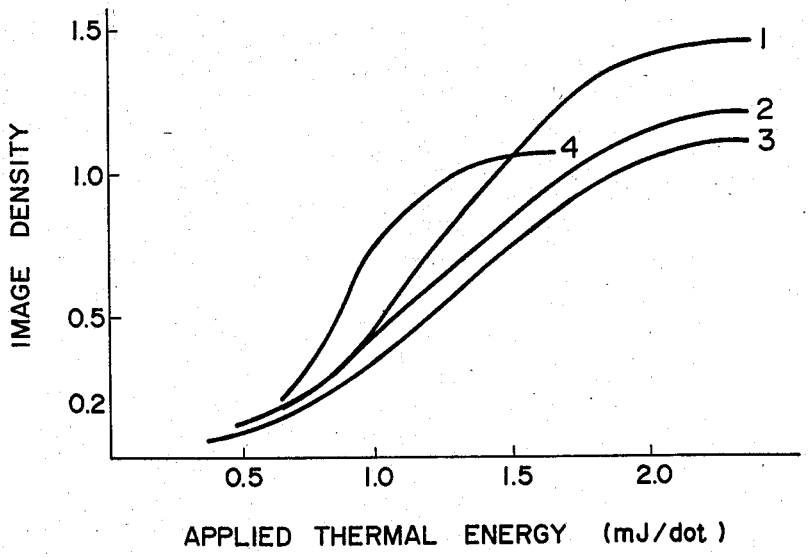
FIG. 8 is a graph showing the relationship between the image density and thermal energy applied per dot in examples of another thermosensitive image transfer recording material according to the present invention.

The relationship between the applied thermal energies and the obtained image densities is shown by the solid curve (image gradation characteristics curve) 1 in FIG. 8. This curve indicates that the image density varied smoothly in accordance with the variation of the amount of the applied thermal energy, so that image gradation suitable for use in practice was available.

EXAMPLE 12-2

Example 12-1 was repeated except that First Red 1547 (Coloring Agent) employed in Example 12-1 was replaced by Lake Red LC (manufactured by Hoechst), so that a thermosensitive image transfer recording material No. 12-2 according to the present invention was prepared. Thermal printing was performed using this thermosensitive image transfer recording material in the same manner as in Example 12-1. As a result, magenta images with excellent image gradation were obtained as indicated by the image gradation characteristics curve 2 in FIG. 8.

EXAMPLE 12-3

Example 12-1 was repeated except that First Red 1547 (Coloring Agent) employed in Example 12-1 was replaced by Sico Fast Yellow D 1355 (manufactured by BASF), so that a thermosensitive image transfer recording material No. 12-3 according to the present invention was prepared. Thermal printing was performed using this thermosensitive image transfer recording material in the same manner as in Example 2-1. As a result, yellow images with excellent image gradiation were obtained as indicated by the image gradation characteristics curve 3 in FIG. 8.

EXAMPLE 12-4

A mixture of the following components was dispersed in a ball mill at 68° C. for about 48 hours:

| | Part by Weight |
|---|---|
| Lake Red C 405 (Coloring Agent) (manufactured by Dainichi Seika and Chemicals Mfg. Co., Ltd.) | 8 |

-continued

| | Part by Weight |
|---|---|
| Needle-like zinc oxide (Image Gradation Control Agent) | 15 |
| Machine oil | 20 |
| Carnauba wax (Carrier Material) | 20 |
| Caster wax (Carrier Material) | 20 |
| Sorbon T-80 (Non-ionic surfactant, sorbitan monooleate, manufactured by Toho Chemical Industry Co., Ltd.) (Dispersing Agent) | 0.5 |
| Liquid paraffin | 4 |
| Methyl ethyl ketone | 100 |
| Toluene | 130 |

To the above dispersion, 300 parts by weight of a 20 wt. % vinyl chloride-vinyl acetate copolymer solution (comprising vinyl chloride-vinyl acetate copolymer, toluene and methyl ethyl ketone, with the mixing ratio thereof being 10:20:20) were added. The mixture was dispersed for about 1 hour in a ball mill, so that a thermofusible ink layer formation liquid was prepared.

The thus prepared thermofusible ink layer formation liquid was coated on the front side of a polyester film backed with a silicone resin heat resistant layer, having a thickness of 6 μm, by a wire bar, and was then dried at 100° C. for 1 minute, so that a thermofusible ink layer having a thickness of about 5 μm was formed on the polyester film, whereby a thermosensitive image transfer recording medium No. 12-1 according to the present invention was prepared.

Thermal printing was performed on this thermosensitive image transfer recording medium in the same manner as mentioned previously, whereby black images were obtained.

The relationship between the applied thermal energies and the obtained image densities is shown by the solid curve (image gradation characteristics curve) 4 in FIG. 8. This curve indicates that the image density varied smoothly in accordance with the variation of the amount of the applied thermal energy, so that image gradation suitable for use in practice was available.

COMPARATIVE EXAMPLE 12-1A

Example 12-1 was repeated except that First Red 1547 (coloring agent) employed in Example 12-1 was replaced by a copper phthalocyanine type dye, Helitogen Blue D 7030 (manufactured by BASF), so that a comparative thermosensitive image transfer recording material No. 12-1A was prepared. Thermal printing was performed using this thermosensitive image transfer recording material in the same manner as in Example 12-1. The result was that the image density of the recorded images was not more than 0.2, so that the employed coloring agent was unsuitable for use in practice.

COMPARATIVE EXAMPLE 12-1B

Example 12-1 was repeated except that First Red 1547 (coloring agent) employed in Example 12-1 was replaced by Paliogen Red K 3580 (manufactured by BASF), having the following formula, so that a comparative thermosensitive image transfer recording material No. 12-1B was prepared. Thermal printing was performed using this thermosensitive image transfer recording material in the same manner as in Example 12-1. The result was that the image density of the recorded images was not more than 0.2, so that the employed coloring agent was unsuitable for use in practice.

COMPARATIVE EXAMPLE 12-1C

Example 12-1 was repeated except that First Red 1547 (coloring agent) employed in Example 12-1 was replaced by a disazo compound, Vulcan Fast Orange GRN, so that a comparative thermosensitive image transfer recording material No. 12-1C was prepared. Thermal printing was performed using this thermosensitive image transfer recording material in the same manner as in Example 12-1. The result was that the image density of the recorded images was not more than 0.2, so that the employed coloring agent was unsuitable for use in practice.

COMPARATIVE EXAMPLE 12-1D

Example 12-1 was repeated except that First Red 1547 (coloring agent) employed in Example 12-1 was replaced by carbon black, Printex 90 (manufactured by Degussa), so that a comparative thermosensitive image transfer recording material No. 12-1D was prepared. Thermal printing was performed using this thermosensitive image transfer recording material in the same manner as in Example 12-1. The result was that the image density of the recorded images was not more than 0.2, so that the employed coloring agent was unsuitable for use in practice.

COMPARATIVE EXAMPLE 12-1E

Example 12-1 was repeated except that First Red 1547 (coloring agent) employed in Example 12-1 was replaced by a disazo compound, Vulcan Fast Orange GRN, so that a comparative thermosensitive image transfer recording material No. 12-1E was prepared. Thermal printing was performed using this thermosensitive image transfer recording material in the same manner as in Example 12-1. The result was that the image density of the recorded images was not more than 0.2, so that the employed coloring agent was unsuitable for use in practice.

COMPARATIVE EXAMPLE 12-1F

Example 12-1 was repeated except that First Red 1547 (coloring agent) employed in Example 12-1 was replaced by carbon black, Printex 90 (manufactured by Degussa), so that a comparative thermosensitive image transfer recording material No. 12-1F was prepared. Thermal printing was performed using this thermosensitive image transfer recording material in the same manner as in Example 12-1. The result was that the image density of the recorded images was not more than 0.2, so that the employed coloring agent was unsuitable for use in practice.

Recorded-image-bearing receiving sheets prepared by use of the above thermosensitive image transfer recording materials Nos. 12-1, 12-2, 12-3 and 12-4 according to the present invention were exposed to the light emitted from a fade meter for 24 hours, so that the the decrease in the image density of each receiving sheet was measured to see the light resistance of each recorded image. The above recorded-image-bearing receiving sheets were also placed in a constant-temperature chamber at 60° C. for one week to see the durability thereof. The result was that in each receiving material, the decrease in image density was less than 10% in both the light resistance test and the durability test.

The same results applied to the other thermosensitive image transfer materials according to the present invention in the above-described tests.

What is claimed is:

1. A thermosensitive image transfer recording medium comprising a support material and a thermofusible ink layer formed thereon, comprising a fine porous resin structure made of a resin containing therein (a) a coloring agent, and (b) a carrier material for holding said coloring agent at normal temperatures and for carrying said coloring agent out of said thermofusible ink layer for image formation upon application of heat thereto, and an image gradiation control agent comprising a pigment which is more wetting and more compatible with said resin of said fine porous resin than with said carrier material, and remains in said fine porous resin structure, without being transported from said porous resin structure when thermal energy is applied to said recording medium.

2. The thermosensitive image transfer recording medium as claimed in claim 1, wherein said fine porous resin structure is made of a thermosetting resin.

3. The thermosensitive image transfer recording medium as claimed in claim 2, wherein said thermosetting resin is selected from the group consisting of phenol resin, furan resin, formaldehyde resin, urea resin, melamine resin, alkyd resin and unsaturated polyester and epoxy resin.

4. The thermosensitive image transfer recording medium as claimed in claim 1, wherein said fine porous resin structure is made of a thermoplastic material.

5. The thermosensitive image transfer recording medium as claimed in claim 4, wherein said thermoplastic resin is selected from the group consisting of homopolymers and copolymers or vinyl chloride, vinyl acetate, vinylidene chloride, acrylic acid, methacrylic acid, acrylic acid esters and methacrylic acid esters.

6. The thermosensitive image transfer recording medium as claimed in claim 1, wherein said image gradation control agent comprises a needle-like pigment which constitutes a network structure.

7. The thermosensitive image transfer recording medium as claimed in claim 6 wherein said needle-like pigment is selected from the group consisting of ochre, Chrome Yellow G, Phthalocyanine pigments, Lithol Red, BON Maroon Light, terra abla, needle zinc oxide, 2,7-bis[2-hydroxy-3-(2-chlorophenyl-carbamoyl)naphthalene-1-ylazo]-9-fluorenone, 4',4''-bis[2-hydroxy-3-(2,4-dimethylphenyl)carbamoylnaphthalene-1-ylazo]-1,4-distyrylbenezene.

8. The thermosensitive image transfer recording medium as claimed in claim 6, wherein said needle-like pigment is 0.3 to 3 μm long and not more than 0.5 μm wide and thick.

9. The thermosensitive image transfer recording medium as claimed in claim 6, wherein the amount of said needle-like pigment is 0.1 to 10 parts by weight to 1 part by weight of said coloring agent.

10. The thermosensitive image transfer recording medium as claimed in claim 6, wherein the ratio by weight of said image gradation control agent to the resin of said fine porous structure is in the range of 0.05 to 2.0.

11. The thermosensitive image transfer recording medium as claimed in claim 1, wherein said image gradation control agent is selected from the group consisting of the perylene compounds:

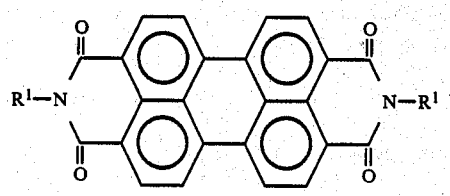

(I)

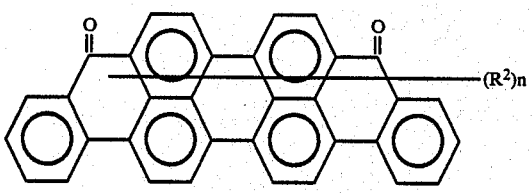

(II)

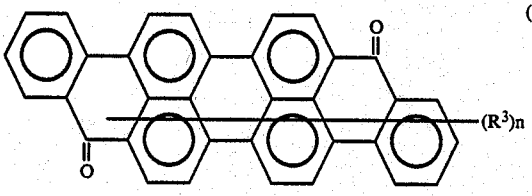

(III)

wherein $R^1$ represents hydrogen, an unsubstituted or substituted alkyl group or an unsubstituted or substituted aryl group; $R^2$ and $R^3$ each represent an unsubstitiuted or substitiuted alkyl or alkoxy group, halogen or a nitro group; n is an integer of 0, 1, 2, 3 or 4.

12. The thermosensitive image transfer recording medium as claimed in claim 1, wherein said image gradation control agent is selected from the group consisting of metal-free phthalocyanine, metal-free phthalocyanine derivatives, metal phthalocyanine and metal phthalocyanine derivatives.

13. The thermosensitive image transfer recording medium as claimed in claim 1, wherein said image gradation control agent is an azo compound having the formula of:

$$X\text{-}(N{=}N{-}Y)_n$$

wherein X represents a diazonium salt moiety, Y represents a coupler moiety, and n is an integer of 1, 2 or 3.

14. The thermosensitive image transfer recording medium as claimed in claim 1, wherein said coloring agent is selected from the group consisting of direct dyes, acid dyes, basic dyes, mordant dyes, sulfur dyes, vat dyes, azoic dyes, oil dyes and thermosublimable disperse dyes.

15. The thermosensitive image transfer recording medium as claimed in claim 1, wherein said coloring agent is a finely-divided pigment having a particle size of 1.0 m or less selected from the group consisting of:

Permanent Yellow GG 02 (C.I. Pigment Yellow 17),
Permanent Yellow DHG trans 02 (C.I. Pigment Yellow 12),
Novoperm Yellow HR 03 (C.I. Pigment Yellow 83),
Hansa Brilliant Yellow 5GX 02 (C.I. Pigment Yellow 74),
Permanent Orange RL 01 (C.I. Pigment Orange 34),
Novoperm Red HFG (C.I. Pigment Orange 38),
Novoperm Red HFT (C.I. Pigment Red 175),
Permanent Lake Red LCLL 02 (C.I. Pigment Red 53:1),
Novoperm Red HF 4B (C.I. Pigment Red 187),
Permanent Carmine FBB02 (C.I. Pigment Red 146),
Permanent Rubine L 6B (C.I. Pigment Red 57:1),
Hostaperm Pink E trans (C.I. Pigment Red 122), and
Reflex Blue R 50 (C.I. Pigment Blue 61).

16. The thermosensitive image transfer recording medium as claimed in claim 1, wherein said coloring agent is selected from the group consisting of cyan oil-soluble phthalocyanine dyes having the formula:

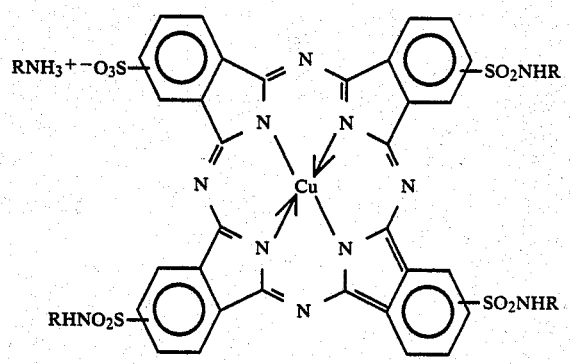

where R represents hydrogen, an unsubstituted or substituted alkyl group or aryl group.

17. The thermosensitive image transfer recording medium as claimed in claim 1, wherein said coloring agent is selected from the group consisting of magenta and yellow oil-soluble metal-containing dyes.

18. The thermosensitive image transfer recording medium as claimed in claim 1, wherein said coloring agent is a monoazo dye having the formula:

$$X{-}N{=}N{-}Y$$

wherein X represents a diazonium salt moiety and Y represents a coupler moiety.

19. The thermosensitive image transfer recording medium as claimed in claim 1, wherein said carrier material is a thermofusible solid material, which is incompatible with the resin of said fine porous resin structure.

20. The thermosensitive image transfer recording medium as claimed in claim 1, wherein said carrier material is selected from the group consisting of carnauba wax, paraffin wax, microcystalline wax and castor wax, stearic acid, palmitic acid, lauric acid, aluminum stearate, lead stearate, barium stearate, zinc stearate, zinc palmitate, methylhydroxy stearate, glycerol monohydroxy stearate, polycaprolactone, polyethylene, polypropylene, polyisobutylene, polyethylene wax, polyethylene oxide, polyfluoroethylene, ethylene-acrylic acid copolymer, ethylene-ethyl acrylate copolymer and ethylene-vinyl acetate copolymer.

21. The thermosensitive image transfer recording medium as claimed in claim 1, further comprising an auxiliary oil component selected from the group consisting of lanolin fatty acid, metal salts of lanolin fatty acid and esters of lanolin fatty acid.

22. The thermosensitive image transfer recording medium as claimed in claim 1, further comprising an auxiliary oil component selected from the group consisting of cotton oil, rape oil, whale oil, lard, machine oil, motor oil, spindle oil, dynamo oil and vaseline.

23. The thermosensitive image transfer recording medium as claimed in claim 1, wherein said fine porous resin structure has an average surface pore diameter of 10 μm or less.

24. The thermosensitive image transfer recording medium as claimed in claim 1, wherein said image gradation control agent comprises finely-divided inorganic or organic particles selected from the group consisting of finely-divided zinc oxide, tin oxide, aluminum oxide, aluminum, copper, cobalt, diatomaceous earth, Molecular Sieves, phenolic resin, epoxy resin and carbon black.

25. The thermosensitive image recording medium as claimed in claim 24, wherein the particle size of said finely-divided particles is in the range of 0.01 μm to 200 μm.

26. The thermosensitive image transfer recording medium as claimed in claim 24, wherein the ratio by weight of said image gradation control agent to the resin of said fine porous structure is in the range of 0.05 to 2.0.

* * * * *